US009327853B2

(12) United States Patent
Tang

(10) Patent No.: US 9,327,853 B2
(45) Date of Patent: May 3, 2016

(54) AUTOMATED SYSTEM AND METHOD FOR CONSTRUCTING CARD MULTIPACKS

(75) Inventor: Michael Tang, Monterey Park, CA (US)

(73) Assignee: Harvard Label Inc., City of Industry, CA (US)

( * ) Notice: Subject to any disclaimer, the term of this patent is extended or adjusted under 35 U.S.C. 154(b) by 0 days.

(21) Appl. No.: 13/423,105

(22) Filed: Mar. 16, 2012

(65) Prior Publication Data

US 2012/0234909 A1 Sep. 20, 2012

Related U.S. Application Data

(60) Provisional application No. 61/465,236, filed on Mar. 16, 2011.

(51) Int. Cl.
*G06K 7/10* (2006.01)
*B65B 11/50* (2006.01)

(52) U.S. Cl.
CPC ..... *B65B 11/50* (2013.01)

(58) Field of Classification Search
CPC . G06K 7/10722; G06K 7/10861; B65B 11/50
USPC ..... 235/375, 454, 462.01, 462.14, 462.41, 235/475, 478, 479, 483
See application file for complete search history.

(56) References Cited

U.S. PATENT DOCUMENTS 5,033,725 A * 7/1991 van Duursen ..... 270/52.02
5,388,815 A * 2/1995 Hill et al. ..... 270/32
5,433,364 A * 7/1995 Hill et al. ..... 225/96
5,509,886 A * 4/1996 Hill et al. ..... 493/419
5,777,305 A * 7/1998 Smith et al. ..... 235/380
5,862,979 A * 1/1999 Hill et al. ..... 229/92.1
5,918,909 A * 7/1999 Fiala et al. ..... 283/61
5,923,015 A * 7/1999 Hill et al. ..... 235/380
6,142,376 A * 11/2000 Cherry et al. ..... 235/462.14
6,328,341 B2 * 12/2001 Klure ..... 283/62
6,846,278 B1 * 1/2005 Hill et al. ..... 493/419
6,957,737 B1 * 10/2005 Frederickson et al. ..... 206/449
7,036,723 B1 * 5/2006 Hill et al. ..... 235/380
7,063,255 B2 * 6/2006 Algiene ..... 235/380
7,118,042 B2 * 10/2006 Moore et al. ..... 235/462.48
7,341,190 B2 * 3/2008 Moore et al. ..... 235/454
7,354,004 B2 * 4/2008 Andersen et al. ..... 235/487
7,740,170 B2 * 6/2010 Singh et al. ..... 235/380
8,256,682 B2 * 9/2012 Chakiris et al. ..... 235/486
8,370,205 B2 * 2/2013 Arthur ..... 705/17
2003/0146285 A1 * 8/2003 Moore et al. ..... 235/462.48
2004/0108374 A1 * 6/2004 Greene et al. ..... 235/375
2004/0111348 A1 * 6/2004 Greene et al. ..... 705/36
2005/0150942 A1 * 7/2005 Greene et al. ..... 235/375
2006/0261154 A1 * 11/2006 Arthur et al. ..... 235/380
2007/0045404 A1 * 3/2007 Andersen et al. ..... 235/380
2008/0114696 A1 * 5/2008 Singh et al. ..... 705/66

(Continued)

*Primary Examiner* — Paultep Savusdiphol
(74) *Attorney, Agent, or Firm* — Lewis Roca Rothgerber Christie LLP

(57) ABSTRACT

Automated systems and methods for constructing card multipacks. An automated system for constructing card multipacks includes: a movable conveyor; a first carrier placing station configured to place a first carrier portion of a carrier on the conveyor; at least one card placing station configured to place a plurality of stored value cards on the first carrier portion; a data capture station configured to read a card bar code of each of the plurality of stored value cards in-line in the automated system; and a software system adapted to create a data file including the card bar codes.

23 Claims, 36 Drawing Sheets

(56) References Cited

U.S. PATENT DOCUMENTS

2008/0217415 A1* 9/2008 Royer ..... 235/493
2009/0218392 A1* 9/2009 Biskupski et al. ..... 235/375
2009/0218408 A1* 9/2009 Biskupski et al. ..... 235/493
2009/0283594 A1* 11/2009 Walton et al. ..... 235/383
2010/0219099 A1* 9/2010 Schmitt et al. ..... 206/776

* cited by examiner

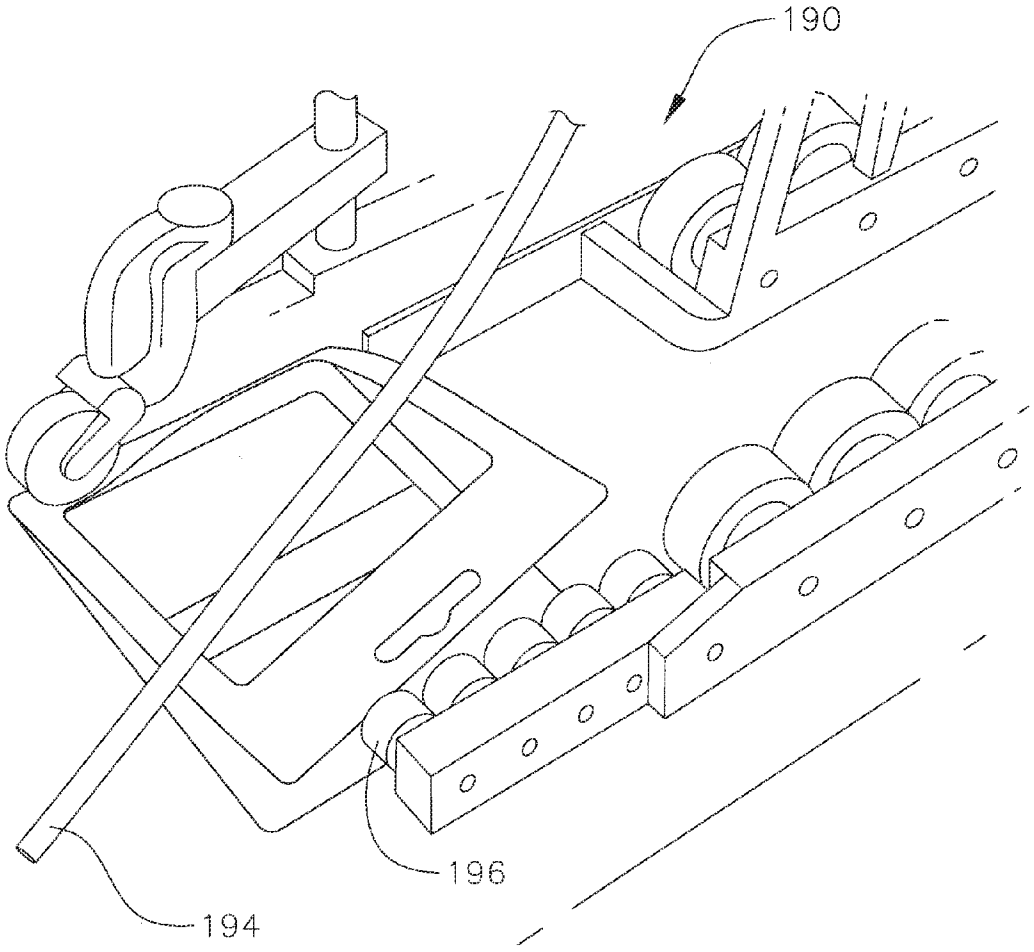
FIG.19
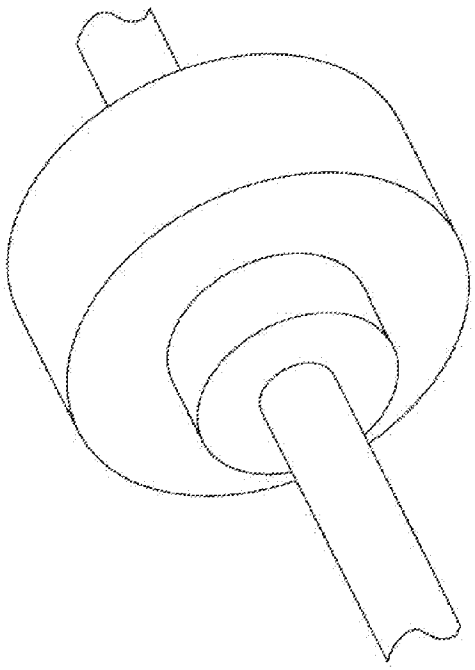

AUTOMATED SYSTEM AND METHOD FOR CONSTRUCTING CARD MULTIPACKS

CROSS-REFERENCE TO RELATED APPLICATION

This application claims priority to and the benefit of U.S. Provisional Patent Application No. 61/465,236, filed on Mar. 16, 2011 in the United States Patent and Trademark Office, the entire content of which is incorporated herein by reference.

FIELD

Aspects of embodiments of the present invention relate to card packages, and more particularly, to automated systems and methods for constructing card multipacks.

BACKGROUND

Stored value cards distributed by financial institutions and/or telephone companies are typically forwarded to retail merchants for sale to individual purchasers. These stored value cards allow the holder prepaid access to existing phone networks for making phone calls, for example, eliminating the need to carry cash on hand. Additionally, stored value cards may be used to provide authorization for the rental or purchase of goods and services, or may be used as a gift certificate granting the holder credit for various goods and services.

Stored value cards are typically purchased by merchants similar to any other good, and displayed for sale in the merchants' stores. In order to reduce their exposure to the loss of the valuable cards through theft or fraud, it is typically the practice for merchants to sell non-activated, or "zero balance" stored value cards which have no intrinsic value until they are activated by the merchant's magnetic, bar code, and/or radio-frequency card reader. It is now a common practice to sell such cards to purchasers with the activation taking place at the merchant counter at the time of sale. Moreover, as a result of this practice, the merchant reduces his overhead because the value of the inactivated stored value cards is not payable to the wholesale vendor of the cards until the card itself is actually distributed by the merchant at the point of sale.

Stored value cards are often sold mounted in or on some sort of card carrier and/or protective display package. These cards, however, may still be susceptible to theft and/or fraud due to tampering. For example, the confidential code may be pre-accessed by a malicious person such that the purchased value of the unsuspecting legitimate purchaser may be later stolen. In order to reduce the chance of theft or fraud, it is typically the practice that a stored value card is not activated until purchase. That is, upon sale of a stored value card to a purchaser, the merchant electronically activates the stored value card with a specific balance paid for by the purchaser, and the purchaser may utilize the stored value using a confidential code provided in the card. Additionally, a database containing activation codes and balance data is typically maintained by a processing company, which is notified electronically by the merchant when the card has been activated. Alternatively, the processing company may perform the activation of the card upon receiving an electronic message from the merchant that the particular card has been purchased.

In the purchasing of stored value cards, it is often desirable to purchase more than one card in a single purchase. As such, stored value card multipacks (i.e. display packages containing multiple cards) have been created. Such multipacks allow a purchaser to purchaser more than one card in a single purchase, such as several cards each having a relatively low redemption value as opposed to a single card having a high value. However, there are additional complexities in the packaging, activation, data-keeping, and fraud protection of such stored value card multipacks, and one or more of these tasks is typically performed manually during the manufacturing of the stored value card multipacks which may enable fraud and theft at the manufacturing stage. Further, while stored value card multipacks have been manufactured with data printed on an inside surface of the packaging, such data has been packaging inventory control data that was not used in automating the manufacturing of the stored value card multipacks.

As discussed above, fraud and theft is a common problem associated with stored value cards and, unfortunately, may occur during the manufacturing and/or packaging of the cards. For example, it is possible that the bar codes of the individual cards may be copied and produced on duplicate cards. As such, there is a need for a system that reduces fraud and theft during manufacturing and packaging of stored value cards, including stored value card multipacks. Additionally, there is a need to provide a stored value card with a high degree of fraud protection so that it can be readily observed if the card has been tampered with.

SUMMARY

According to an aspect of embodiments of the present invention, an automated packaging apparatus is configured to sequentially place cards, such as gift cards or debit cards, of a plurality of cards into a card package (i.e. a multipack). According to aspects of embodiments of the present invention, systems, apparatuses, and methods for constructing a card multipack reduce manual handling and packaging errors, packaging time and cost, and opportunity for fraud and theft.

According to another aspect of embodiments of the present invention, an automated system for constructing card multipacks is configured to read bar codes from stored value cards, create a data file with the bar codes, and package the stored value cards in the card multipacks, each being performed in-line in the automated system without human interaction. According to another aspect of embodiments of the present invention, an automated system for constructing card multipacks is configured to read card bar codes in-line from a plurality of stored value cards, to create a data file linking, or associating, a card bar code of a parent card of the plurality of stored value cards and at least one card bar code of at least one child card of the plurality of stored value cards, and to package the parent card together with the at least one child card to form a card multipack. According to still another aspect of embodiments of the present invention, an automated system for constructing card multipacks is configured to read at least one card bar code in-line from at least one stored value card and a carrier bar code from a corresponding carrier, to create a data file linking, or associating, the at least one card bar code and the corresponding carrier bar code, and to package the at least one stored value card together with the corresponding carrier to form a card multipack.

According to another aspect of embodiments of the present invention, a software system is adapted to read and store bar codes from stored value cards in-line in an automated system for packaging the stored value cards and to create a data file with the bar codes. According to still another aspect of embodiments of the present invention, a software system is adapted to read at least one card bar code from at least one stored value card and a carrier bar code in-line in an automated system for packaging the at least one stored value card and to create a data file linking, or associating, the at least one card bar code with the carrier bar code for subsequent activation of the at least one stored value card using the carrier bar code or a corresponding magnetic stripe of the carrier.

According to another aspect of embodiments of the present invention, a card multipack for packaging at least one stored value card includes a bar code on a front side that is readable during packaging for creating a data file, and the same bar code on a rear side that is readable after packaging for activation of the at least one stored value card.

According to another aspect of embodiments of the present invention, a method of constructing a card multipack reduces manual handling and database creation, packaging errors, and fraud. A method of constructing a card multipack includes automatically reading card bar codes from stored value cards and carrier bar codes, automatically creating a database linking, or associating, the card bar codes to corresponding carrier bar codes, and packaging the stored value cards together with the corresponding carriers to form card multipacks. According to one aspect, the method includes packaging a plurality of the stored value cards in each of the card multipacks. According to an aspect of embodiments of the present invention, an automated system and method is provided for capturing and building data files in-line in the automated system for any style of carrier or package containing any number of stored value cards.

According to one embodiment of the present invention, an automated system for constructing card multipacks includes: a movable conveyor; a first carrier placing station configured to place a first carrier portion of a carrier on the conveyor; at least one card placing station configured to place a plurality of stored value cards on the first carrier portion; a data capture station configured to read a card bar code of each of the plurality of stored value cards in-line in the automated system; and a software system adapted to create a data file including the card bar codes.

In one embodiment, the data capture station includes a camera configured to create an image of the plurality of card bar codes, and the software system is adapted to create the data file using the image.

In one embodiment, the data capture station is further configured to read a carrier bar code of the carrier, and the software system is further adapted to create in the data file an association between the card bar code of each of the plurality of stored value cards and the carrier bar code for subsequent activation of each of the plurality of stored value cards using the carrier bar code. In one embodiment, the data capture station includes a camera configured to create an image of the plurality of card bar codes and the carrier bar code, and the software system is adapted to create the data file using the image. The first carrier portion may include the carrier bar code.

In one embodiment, the data capture station includes a first camera configured to create a first image of the plurality of card bar codes, and a second camera configured to create a second image of the carrier bar code, and the software system is adapted to create the data file using the first and second images. The software system may be adapted to create the data file using a composite image made up of the first and second images. In one embodiment, the automated system further includes a second carrier placing station between the first camera and the second camera and configured to place a second carrier portion of the carrier on the stored value cards subsequent to the first camera creating the first image, and the second carrier portion includes the carrier bar code.

In one embodiment, the software system is further adapted to create in the data file an association between at least two different card bar codes of at least two stored value cards of the plurality of stored value cards and the carrier bar code for subsequent activation of the at least two stored value cards using the carrier bar code, the automated system being configured to package the at least two stored value cards together with the carrier including the carrier bar code.

In one embodiment, the automated system further includes a sealing station configured to seal the carrier, wherein the data capture station is configured to read the plurality of card bar codes and the carrier bar code between the at least one card placing station and the sealing station.

In one embodiment, the software system is further adapted to create in the data file an association between the card bar code of a parent card of the plurality of stored value cards and the card bar code of each of at least one child card of the plurality of stored value cards.

In one embodiment, the at least one card placing station includes a plurality of card placing stations configured to sequentially place the plurality of stored value cards on the carrier.

In one embodiment, the data capture station is configured to read the plurality of card bar codes and the software system is configured to create the data file in-line in the automated system without human interaction.

In one embodiment, the card multipacks are gift card multipacks.

In one embodiment, the system further includes a second carrier placing station between the first carrier placing station and the at least one card placing station, the second carrier placing station being configured to place a first carrier shell of the carrier on the first carrier portion such that a recessed portion of the first carrier shell protrudes through an opening of the first carrier portion. In one embodiment, the system further includes a third carrier placing station between the at least one card placing station and a sealing station for sealing the card multipack, the third carrier placing station being configured to place a second carrier shell of the carrier over the first carrier shell and the at least one stored value card.

In one embodiment, the sealing station includes a folding blade configured to fold a first portion of the carrier onto a second portion of the carrier, an upper surface of the first portion being inside the card multipack after the first portion is folded onto the second portion; and a dispensing device configured to dispense an adhesive on the carrier for sealing the first and second portions to each other.

According to another embodiment of the present invention, an automated system for constructing card multipacks includes a movable conveyor; a carrier placing station configured to place a carrier portion of a carrier on the conveyor; at least one card placing station configured to place at least one stored value card on the carrier portion; a data capture station configured to read at least one card bar code of the at least one stored value card and a carrier bar code of the carrier in-line in the automated system; and a software system adapted to create a data file associating the at least one card bar code with the carrier bar code.

According to another embodiment of the present invention, a software system for use with an automated system for constructing card multipacks is adapted to read and store a plurality of card bar codes of a plurality of stored value cards in-line in the automated system and to create a data file including the card bar codes.

In one embodiment, the software system is further adapted to create in the data file an association between the card bar code of a parent card of the plurality of stored value cards and the card bar code of each of at least one child card of the plurality of stored value cards. In one embodiment, the software system is further adapted to read a plurality of carrier bar codes in-line in the automated system and to create in the data file an association between the card bar codes and corresponding ones of the carrier bar codes for subsequent activation of the stored value cards using the corresponding carrier bar codes. In one embodiment, the software system is further adapted to create in the data file an association between at least two different card bar codes of at least two stored value cards of the plurality of stored value cards and a corresponding one carrier bar code of the plurality of carrier bar codes for subsequent activation of the at least two stored value cards using the corresponding one miler bar code, the automated system being configured to package the at least two stored value cards together with a carrier including the corresponding one carrier bar code.

According to another embodiment of the present invention, a card multipack for packaging at least one stored value card includes a first bar code that is readable for creating a data file during the packaging of the at least one stored value card; and a second bar code that is scannable after the packaging of the at least one stored value card for activating the at least one stored value card, wherein the second bar code is the same as the first bar code.

In one embodiment, the card multipack further includes a carrier for containing the at least one stored value card, wherein the first bar code is on a first surface of the carrier and the second bar code is on a second surface of the carrier opposite the first surface. A portion of the carrier may be foldable such that when the portion of the carrier is folded, the first bar code is inside the card multipack and the second bar code is on an exterior of the card multipack.

According to another embodiment of the present invention, a method of constructing a card multipack using an automated system includes: placing a first carrier portion of a carrier on a conveyor of the automated system using a first carrier placing station of the automated system; placing a plurality of stored value cards on the first carrier portion using at least one card placing station of the automated system; reading a plurality of card bar codes of the plurality of stored value cards in-line using a data capture station of the automated system; and creating a data file including the card bar codes using a software system of the automated system.

In one embodiment, the method further includes reading a carrier bar code of the carrier inline using the data capture station, wherein creating the data file comprises creating an association between the card bar code of each of the plurality of stored value cards and the carrier bar code for subsequent activation of each of the plurality of stored value cards using the carrier bar code.

In one embodiment, reading the card bar codes and reading the carrier bar code are performed subsequent to placing the stored value cards on the first carrier portion, and the method further includes sealing the card multipack subsequent to reading the card bar codes and reading the carrier bar code.

In one embodiment, reading the card bar codes includes creating an image of the card bar codes using a first camera, and reading the carrier bar code includes creating an image of the carrier bar code using a second camera. The method may further include placing a second carrier portion including the carrier bar code on the stored value cards using a second carrier placing station of the automated system subsequent to reading the card bar codes and prior to reading the carrier bar code.

In one embodiment, creating the data file includes creating an association between the card bar code of a parent card of the plurality of stored value cards and the card bar code of each of at least one child card of the plurality of stored value cards.

In one embodiment, the method further includes sealing the card multipack in-line using the automated system.

In one embodiment, the method further includes printing the first package bar code on a first surface of the carrier, and printing a second package bar code on a second surface of the carrier opposite the first surface, the second package bar code being the same as the first package bar code.

Sealing the card package may include folding the carrier such that the first package bar code is inside the card package and the second package bar code is on an exterior of the card package for subsequent activation of the at least one stored value card using the second package bar code. In one embodiment, the method further includes printing the first package bar code on the carrier, and sealing the card package includes folding the carrier such that the first package bar code is on an exterior of the card package for subsequent activation of the at least one stored value card using the first package bar code. Sealing the card package may further include placing an adhesive on the carrier and folding a portion of the carrier onto the adhesive.

In one embodiment, placing the plurality of stored value cards on the carrier includes sequentially placing the plurality of stored value cards on the carrier. The method may further include placing an adhesive on at least one stored value card of the plurality of stored value cards.

In one embodiment, the method further includes placing a first carrier shell on the first carrier portion such that a recessed portion of the first carrier shell protrudes through an opening of the first carrier portion, and placing the stored value cards on the carrier includes placing the stored value cards in the recessed portion of the first carrier shell. The method may further include placing a second carrier shell on the stored value cards over the first carrier shell prior to sealing the card multipack.

Placing the stored value cards on the carrier may include utilizing a vacuum device. In one embodiment, the method further includes tamper-proofing the card package such that the card multipack cannot be opened without visible damage.

According to another embodiment of the present invention, an automated apparatus for constructing card multipacks containing a plurality of cards includes a plurality of stations and a conveyer movable for conveying the card multipacks between the stations, wherein the plurality of stations includes: a carrier placing station at a first end of the apparatus and configured to place a carrier on the conveyor; a first shell placing station configured to place a first shell on the carrier such that a recessed portion of the first shell protrudes through an opening of the carrier; a plurality of card placing stations configured to sequentially place the plurality of cards in the recessed portion of the first shell; and a folding station at a second end of the apparatus opposite the first end, the folding station being configured to fold a portion of the carrier over the first shell and the plurality of cards for containing the plurality of cards in the recessed portion of the first shell, wherein the first shell placing station is between the carrier placing station and the folding station, and the card placing stations are between the first shell placing station and the folding station.

In one embodiment, the plurality of stations further includes a second shell placing station between the plurality of card placing stations and the folding station, the second shell placing station being configured to place a second shell on the carrier over the first shell and the plurality of cards.

The card placing stations may include vacuum devices for placing the cards. In one embodiment, the apparatus further includes a dispensing device configured to dispense an adhesive on at least one of the plurality of cards.

In one embodiment, the apparatus further includes a camera configured to create an image of the plurality of cards and the carrier between the plurality of card placing stations and the folding station. The apparatus may further include a software system adapted to create a data file using the image and associating a plurality of card bar codes on corresponding ones of the plurality of cards with a package bar code on the carrier.

In one embodiment, the apparatus further includes a dispensing device configured to dispense an adhesive on the carrier, and the folding station is configured to fold the portion of the carrier onto the adhesive to seal the card multipack, an upper surface of the portion of the carrier being inside the card multipack after the portion is folded onto the adhesive.

Additional aspects and/or advantages of embodiments of the present invention are set forth in the following description and accompanying drawings, or may be obvious in view thereof to those skilled in the art.

BRIEF DESCRIPTION OF THE DRAWINGS

The above and other features and advantages will become more apparent to those of ordinary skill in the art by describing in detail some exemplary embodiments of the present invention with reference to the attached drawings, in which:

FIGS. 17-21 are perspective views of a carrier of a card multipack being folded using a folding station of the automated system for constructing card multipacks of FIG. 1, according to an embodiment of the present invention;

DETAILED DESCRIPTION

Some exemplary embodiments will now be described more fully hereinafter with reference to the accompanying drawings; however, embodiments of the present invention may be embodied in different forms and should not be construed as limited to the exemplary embodiments illustrated and set forth herein. Rather, these exemplary embodiments are provided by way of example for understanding of the invention and to convey the scope of the invention to those skilled in the art.

Figure 1:
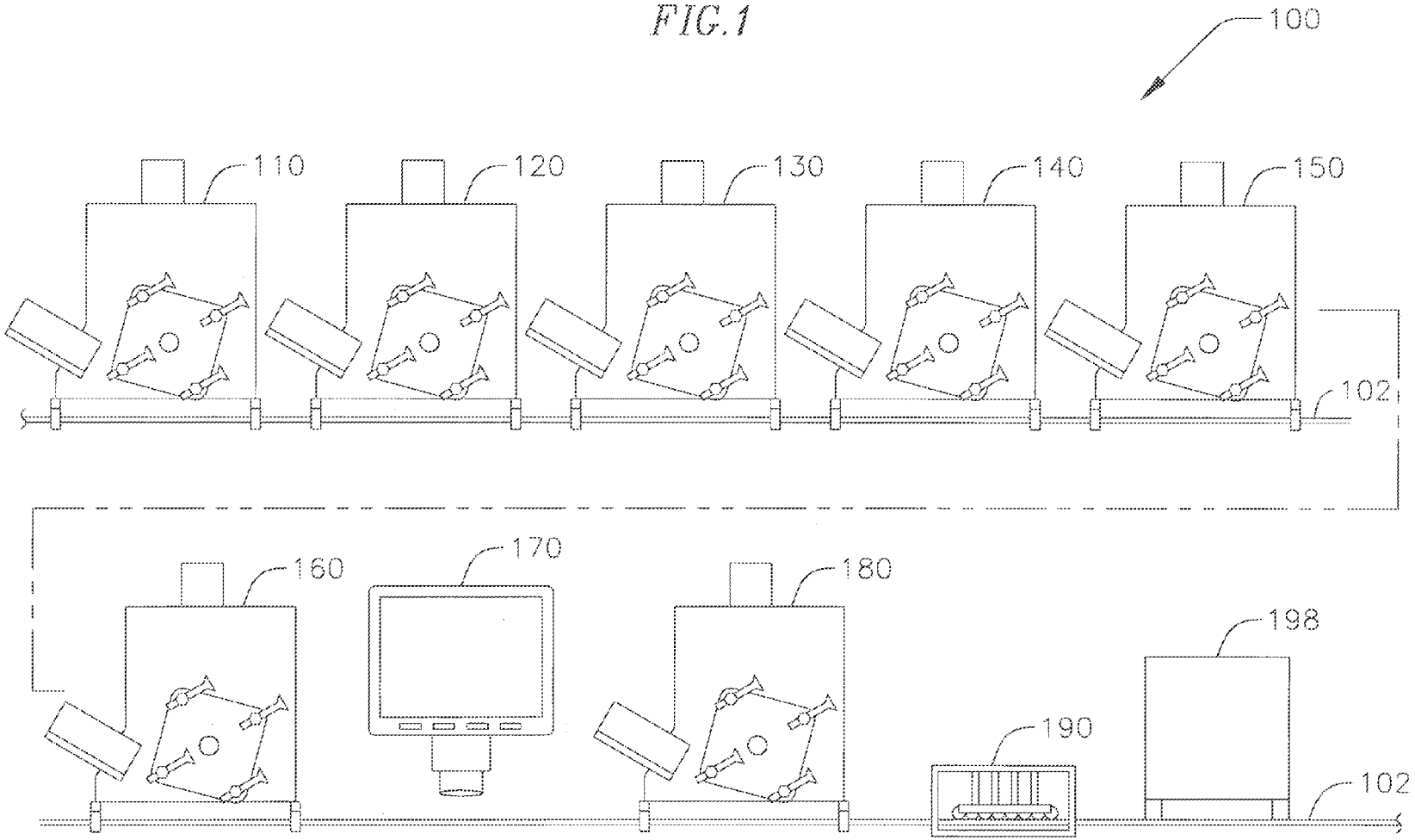
FIG. 1 is a schematic diagram of an automated system or constructing card multipacks according to an embodiment of the present invention.

With reference to FIG. 1, an automated system 100 for constructing card multipacks according to one embodiment of the present invention includes a movable conveyor 102, a first carrier placing station 110, a second carrier placing station 120, a first card placing station 130, a second card placing station 140, a third card placing station 150, a fourth card placing station 160, a data capture station 170, a third carrier placing station 180, a folding station 190, and a sealing/tamper-proofing station 198. The conveyor 102, in one embodiment, is movable between each of the stations and devices shown and described above. Further, in one embodiment, the conveyor 102 is made up of a belt that is driven by a motor but, alternatively, may include any other movable conveying device known in the art.

While the system 100 shown in FIG. 1 including each of the stations and devices described above is one embodiment of the present invention, the present invention is not limited thereto. For example, in other embodiments, one or more of the stations or devices of the system 100 shown in FIG. 1 may be absent and/or additional stations or devices may be added. For example, in one alternative embodiment, the system may have any other desired number of card placing stations rather than four. Further, while in one embodiment of the present invention, the stations and devices of the system 100 shown in FIG. 1 are arranged in the sequence shown relative to one another, the present invention is not limited thereto. That is, the stations and devices of the system 100 may be arranged in any other suitable sequence relative to one another. For example, in one alternative embodiment, the data capture station 170 may be arranged after the third carrier placing station 180 in the line of the system. Further, in one embodiment, as shown in FIG. 1, the stations and devices of the system 100 are arranged in an assembly line form, and the conveyor 102 is configured to move the card multipacks 10 from one station or device to the next.

Figure 2:
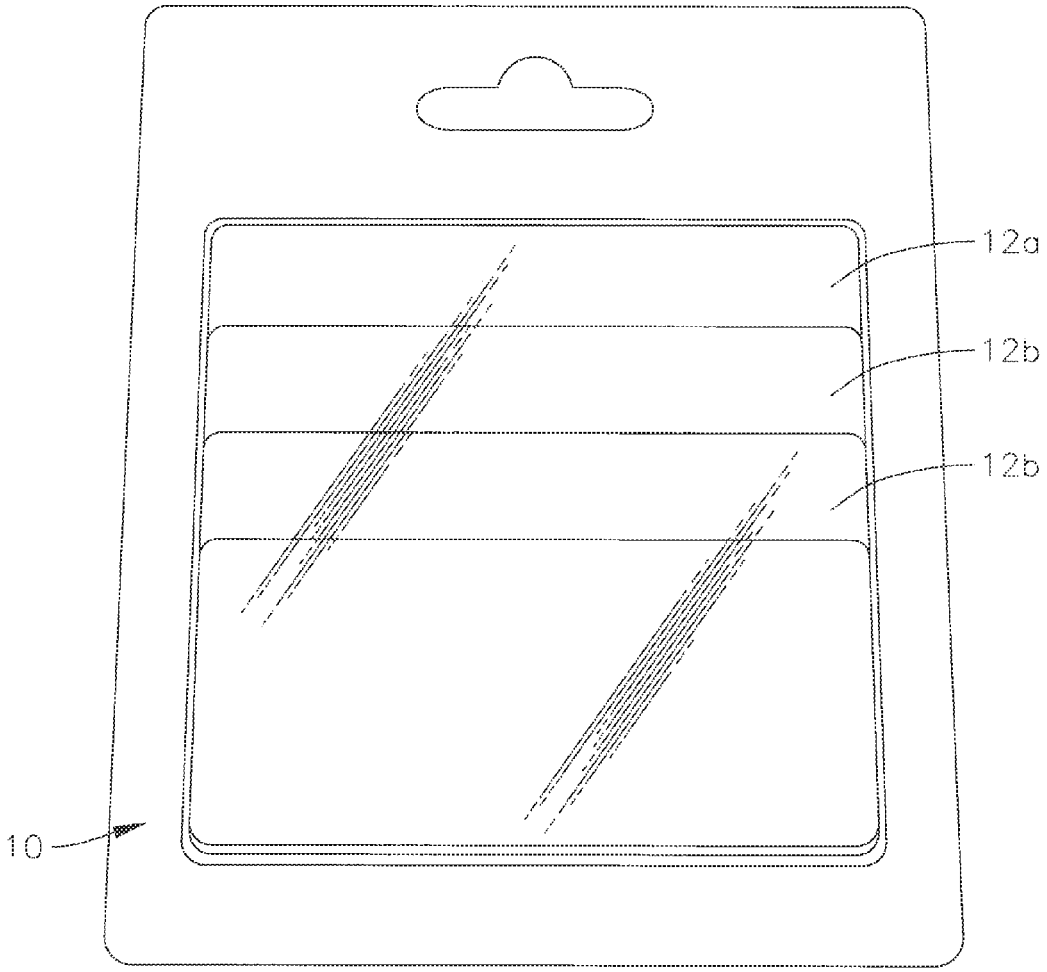
FIG. 2 is a front view of a card multipack constructed using the automated system for constructing card multipacks of FIG. 1, according to an embodiment of the present invention.
Figure 3:
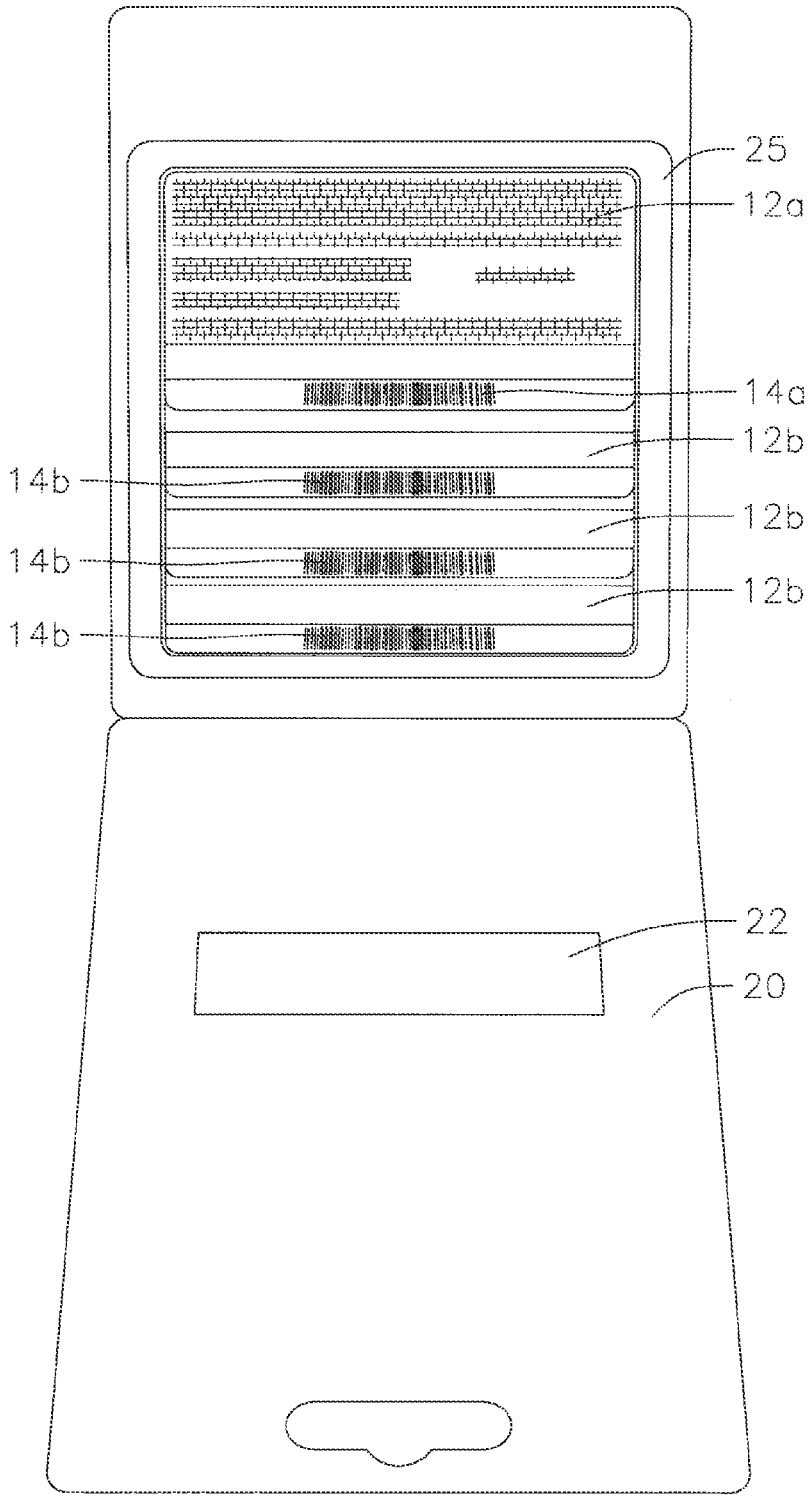
FIG. 3 is a rear view of the card multipack of FIG. 2, shown in an unfolded state.
Figure 4:
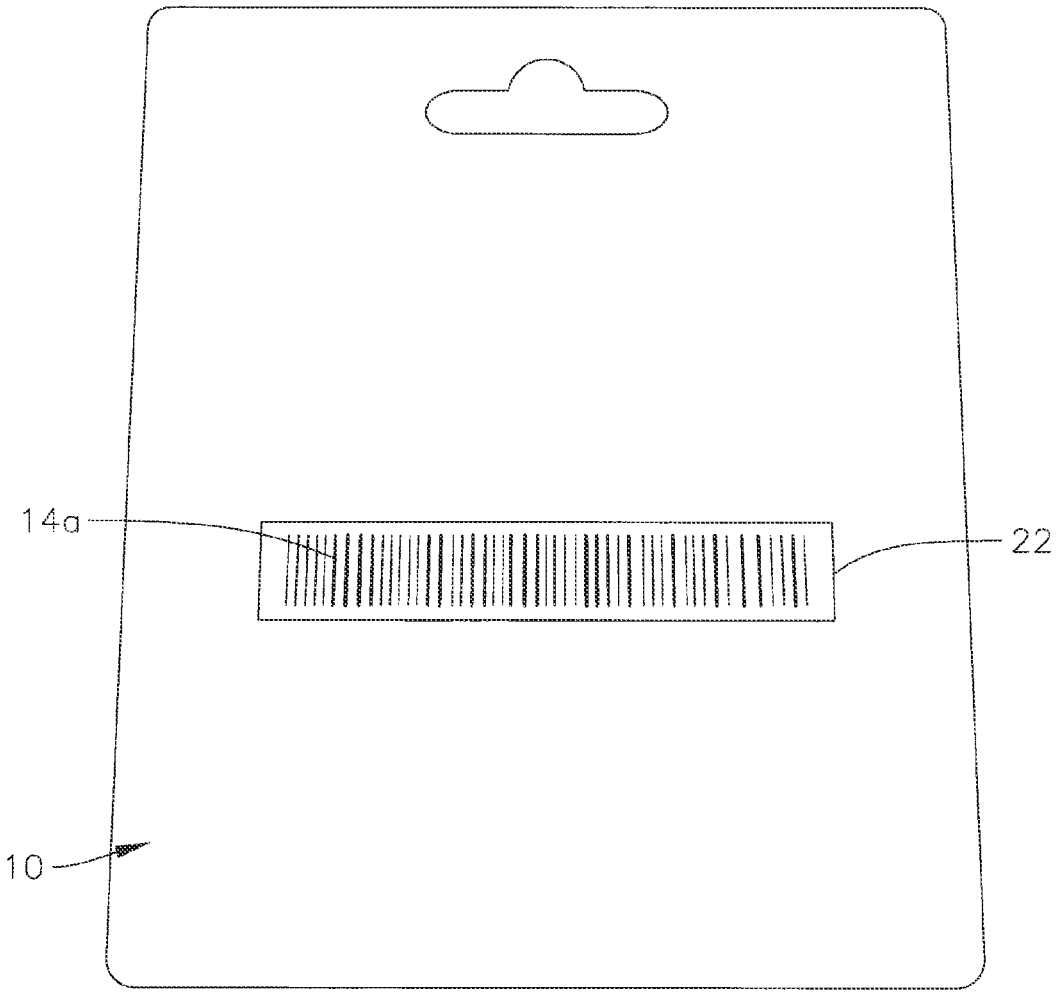
FIG. 4 is a rear view of the card multipack of FIG. 2, shown in a folded state.

With reference to FIGS. 2-4, a card multipack 10 according to one embodiment of the present invention is shown. The card multipack 10, for example, may be constructed using the automated system 100. In FIG. 2, the card multipack 10 is shown in a sealed state containing, for example, four stored value cards 12*a*, 12*b*. The stored value cards, in one embodiment, include a parent card 12*a* and one or more (e.g., three) child cards 12*b*. As used herein, the term "stored value card" refers to any card having a value stored on or associated with the card, including, but not limited to, gift certificates or gift cards, prepaid credit cards, and prepaid phone cards. FIG. 3 shows the card multipack 10 in an unfolded state and shows a parent card bar code 14*a* on the parent card 12*a* and a child card bar code 14*b* on each of the child cards 12*b*. Further, in one embodiment, the stored value cards 12*a*, 12*b* may have magnetic stripes which may be used for activation and/or redemption, for example. In one embodiment, as also shown in FIG. 3, the card multipack 10 includes a carrier base 20 and a first carrier shell 25 holding the stored value cards 12*a*, 12*b*. The card multipack 10 is shown in a folded state in FIG. 4. In one embodiment, as shown in FIGS. 3 and 4, the carrier base 20 has a window 22 through which the parent card bar code 14*a* is readable, or scannable, after the card multipack 10 has been sealed. In another embodiment, one or more of the child card bar codes 14*b* may also be readable, or scannable, through the window 22. In one embodiment, as illustrated by FIGS. 3 and 4,the carrier base 20 is folded prior to or during sealing of the card multipack 10.

Figure 5:
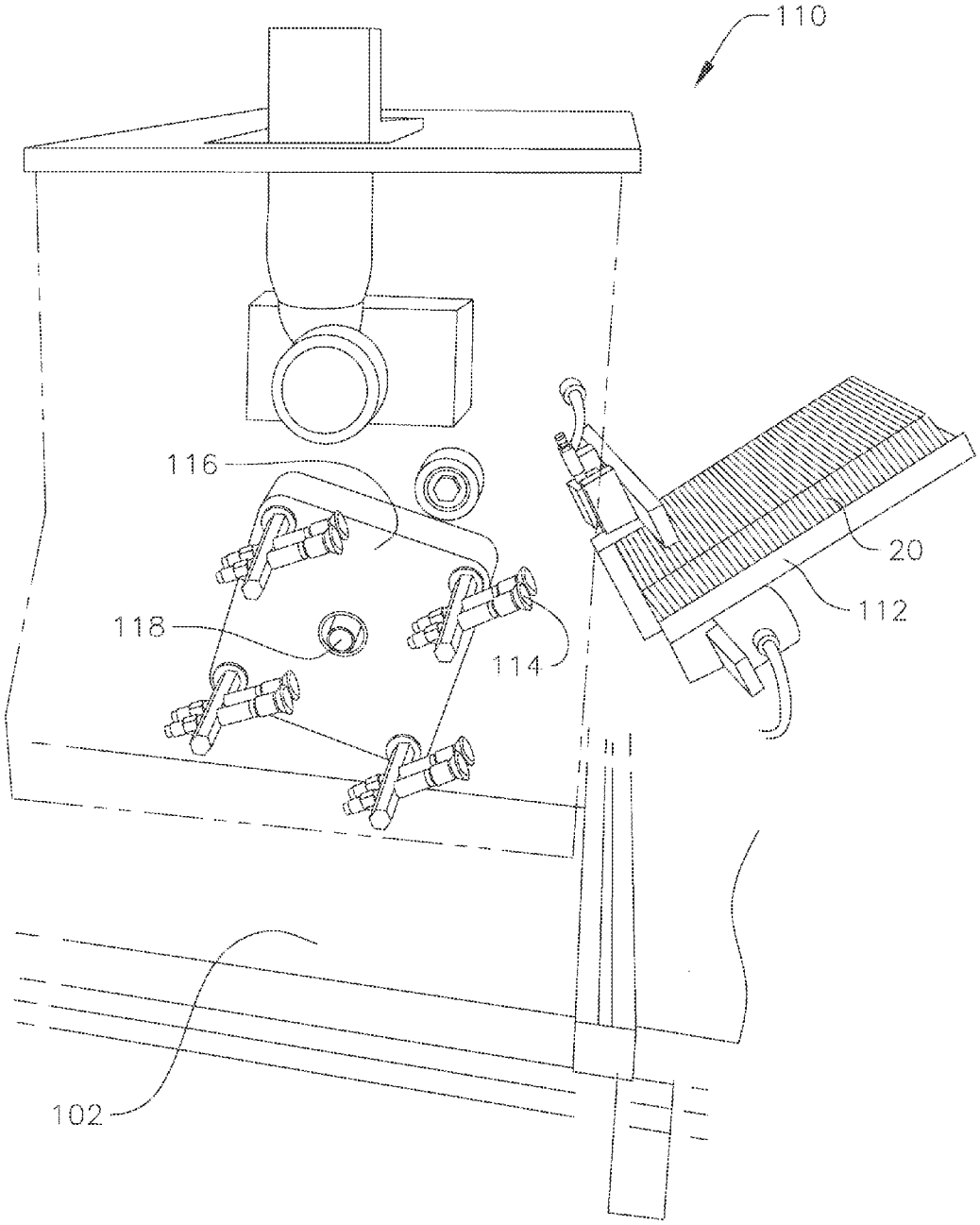
FIG. 5 is a front schematic view of a carrier placing station of the automated system for constructing card multipacks of FIG. 1, according to an embodiment of the present invention.

With reference to FIG. 5, the first carrier placing station 110 is configured to place the carrier base 20 on the conveyor 102. For example, the timing of the conveyor 102 and the first carrier placing station 110 may be set relative to one another by any suitable device or method known in the art. In one embodiment, the first carrier placing station 110 includes a holding rack 112 for holding a stack of the carrier bases 20 to be placed on the conveyor 102. Further, in one embodiment, the first carrier placing station 110 includes one or more placing mechanisms 114 configured to grab one of the carrier bases 20 from the holding rack 112 and place the carrier base 20 on the conveyor 102. In one embodiment, the placing mechanisms 114 are connected to vacuum or suction lines, wherein suction is applied for grabbing and holding the carrier base 20 and is released for placing the carrier base 20 on the conveyor 102. Further, in one embodiment, the placing mechanisms 114 are coupled to a wheel 116 that is rotatable about a shaft 118, and the wheel 116 is rotatable at a desired rate for grabbing and placing the carrier bases 20 on the conveyor 102. However, embodiments of the first carrier placing station 110 of the present invention are not limited to the above-described and shown configuration, but rather, may have any other suitable configuration for placing the carrier base 20 on the conveyor 102.

Figure 6:
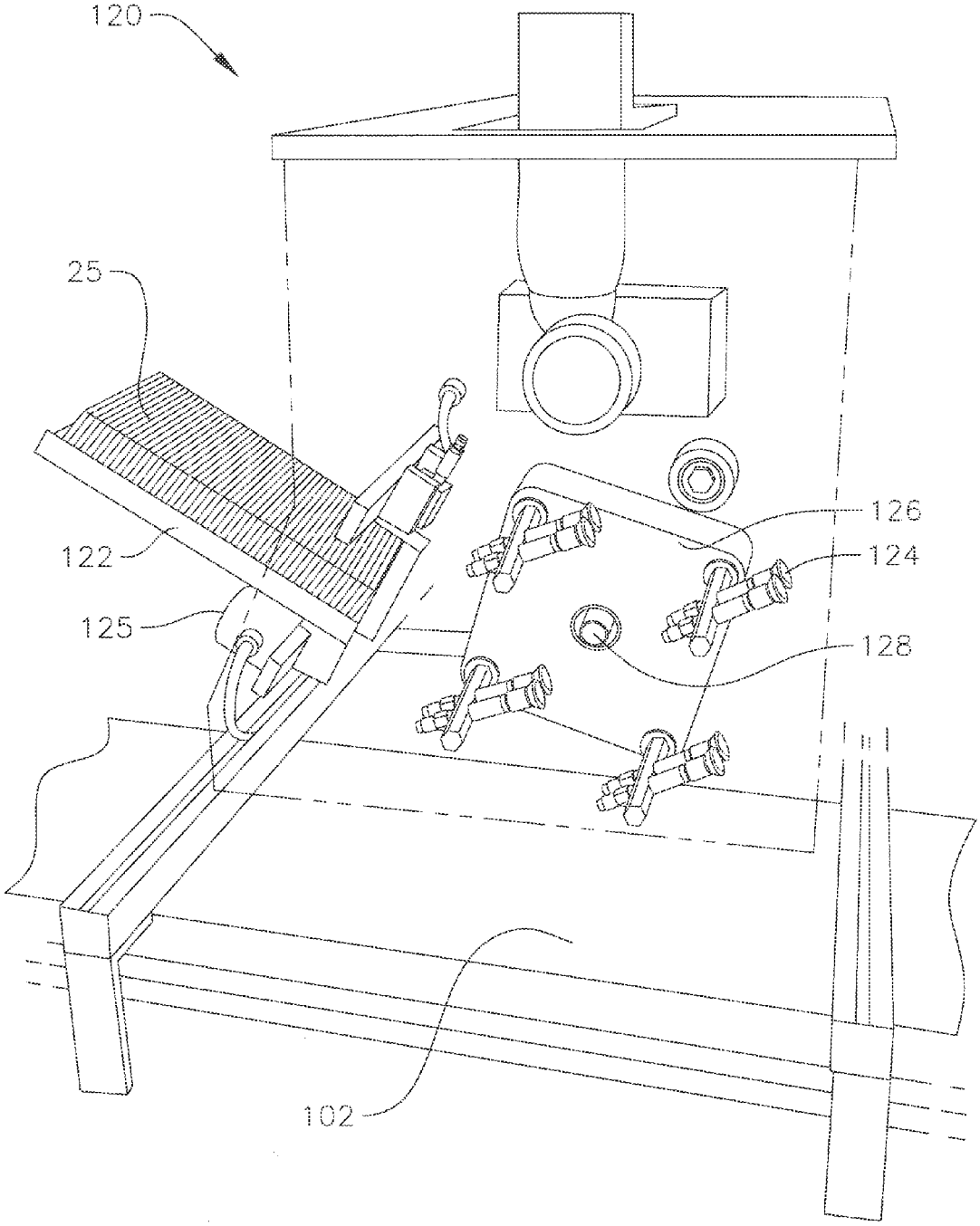
FIG. 6 is a front schematic view of a shell placing station of the automated system for constructing card multipacks of FIG. 1, according to an embodiment of the present invention.

With reference to FIG. 6, the second carrier placing station 120 is configured to place the first carrier shell 25 on the carrier base 20. In one embodiment, the second carrier placing station 120 includes a holding rack 122 for holding a stack of the first carrier shells 25 to be placed on the carrier bases 20. Further, in one embodiment, the second carrier placing station 120 includes one or more placing mechanisms 124 configured to grab one of the first carrier shells 25 from the holding rack 122 and place the first carrier shell 25 on the carrier base 20. In one embodiment, the first carrier shell 25 is placed on the carrier base 20 such that a recessed portion of the first carrier shell 25 protrudes through an opening 24 (see FIG. 10) formed in the carrier base 20. In one embodiment, the placing mechanisms 124 are connected to vacuum or suction lines, wherein suction is applied from a suction-generating device 125 (e.g., a vacuum pump) for grabbing and holding the first carrier shell 25 and is released for placing the first carrier shell 25 on the carrier base 20. Further, in one embodiment, the placing mechanisms 124 are coupled to a wheel 126 that is rotatable about a shaft 128, and the wheel 126 is rotatable at a desired rate for grabbing and placing the first carrier shells 25 on the carrier bases 20. Embodiments of the second carrier placing station 120 of the present invention are not limited to the above-described embodiment, but rather, may have any other suitable configuration for placing the first carrier shells 25 on the carrier bases 20.

Figure 7:
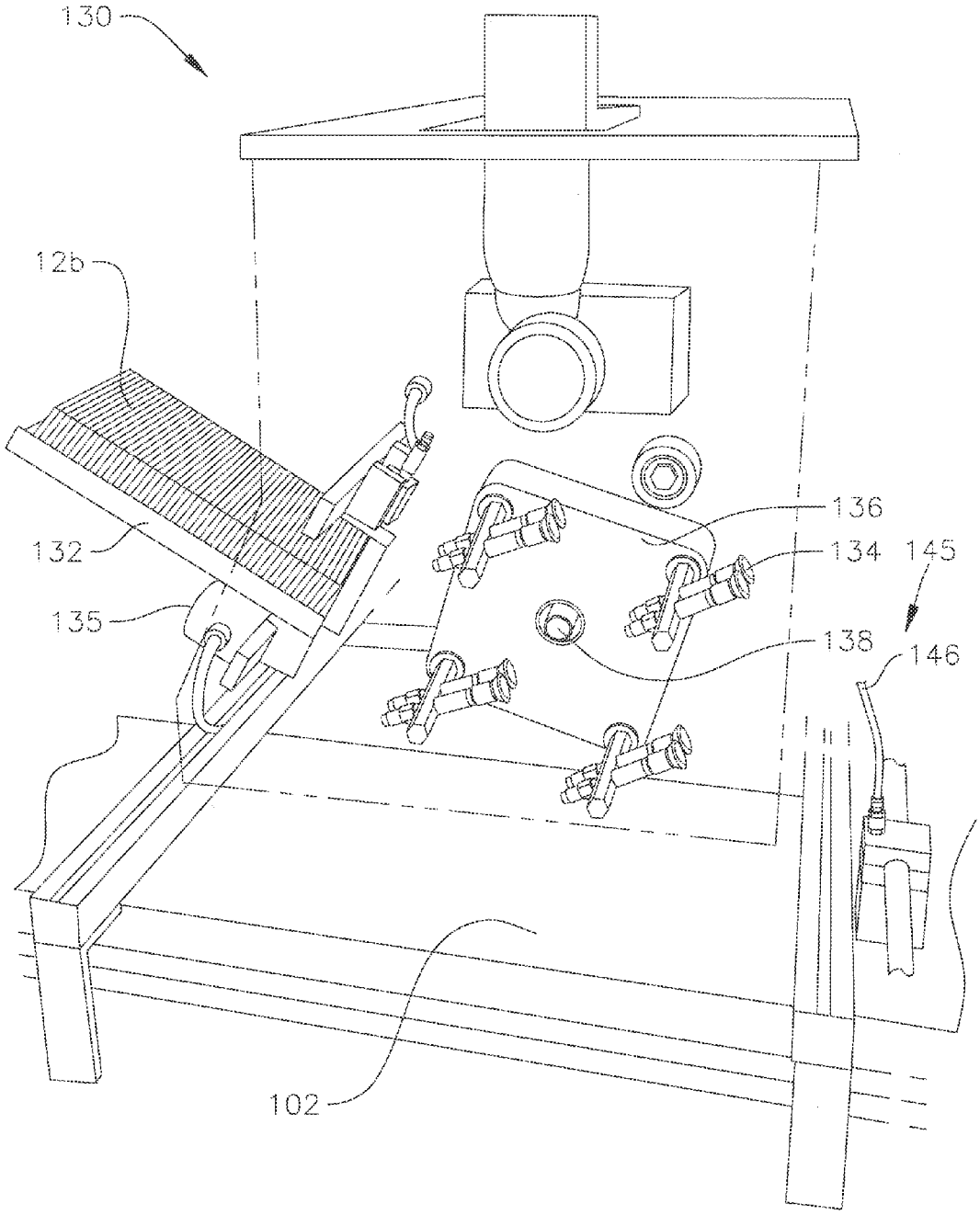
FIG. 7 is a front schematic view of a card placing station of the automated system for constructing card multipacks of FIG. 1, according to an embodiment of the present invention.

With reference to FIG. 7, the first card placing station 130 is configured to place one of the stored value cards 12*b* in the first carrier shell 25. In one embodiment, the first card placing station 130 is configured similarly or the same as the second carrier placing station 120 described above. The first card placing station 130, in one embodiment, includes a holding rack 132 for holding a stack of the stored value cards 12*b* to be placed in the first carrier shells 25. Further, in one embodiment, the first card placing station 130 includes one or more placing mechanisms 134 configured to grab one of the stored value cards 12*b* from the holding rack 132 and place the stored value card 12*b* in the first carrier shell 25. In one embodiment, the placing mechanisms 134 are connected to vacuum or suction lines, wherein suction is applied from a suction-generating device 135 (e.g., a vacuum pump) for grabbing and holding the stored value card 12*b* and is released for placing the stored value card 12*b* in the first carrier shell 25. Further, in one embodiment, the placing mechanisms 134 are coupled to a wheel 136 that is rotatable about a shaft 138, and the wheel 136 is rotatable at a desired rate for grabbing and placing the stored value cards 12*b* in the first carrier shells 25. Embodiments of the first card placing station 130 of the present invention are not limited to the above-described embodiment, but rather, may have any other suitable configuration for placing the stored value cards 12*b* in the first carrier shells 25.

In one embodiment, the second card placing station 140, the third card placing station 150, and the fourth card placing station 160 are each configured similar to or the same as the first card placing station 130 described above and shown in FIG. 7, and therefore will not be described in further detail. Each of the second card placing station 140, the third card placing station 150, and the fourth card placing station 160 are configured to place one of the stored value cards 12*a*, 12*b* on a previously placed one of the stored value cards 12*b* in the first carrier shell 25. As described above, in other embodiments of the system 100, there may be additional card placing stations or fewer than the four card placing stations shown in FIG. 1. In one embodiment, there may be only one card placing station. Further, in one embodiment, one or more of the card placing stations may be configured to place more than one of the stored value cards 12*a*, 12*b* in the first carrier shell 25. Further, the card placing stations 130, 140, 150, 160, in one embodiment, are configured similarly to the second and third carrier placing stations 120, 180 and, in one embodiment, one or both of the second and third carrier placing stations 120, 180 may be utilized as a card placing station or vice versa.

With reference to FIG. 7, the system 100, in one embodiment, includes one or more adhesive dispensing devices 145. The adhesive dispensing devices 145, in one embodiment, are configured to dispense an adhesive on one or more of the stored value cards 12*a*, 12*b* in order to retain the stored value cards 12*a*, 12*b* in place once the stored value cards 12*a*, 12*b* are placed in the first carrier shell 25. In one embodiment, the adhesive dispensing device 145 includes an adhesive supply tube 146 through which the adhesive is supplied via a pump or other suitable device. Further, the adhesive may be dispensed through a nozzle or other suitable device. The one or more adhesive dispensing devices 145, in one embodiment, may be located before or after one or more of the card placing stations 130, 140, 150, 160.

Figure 8:
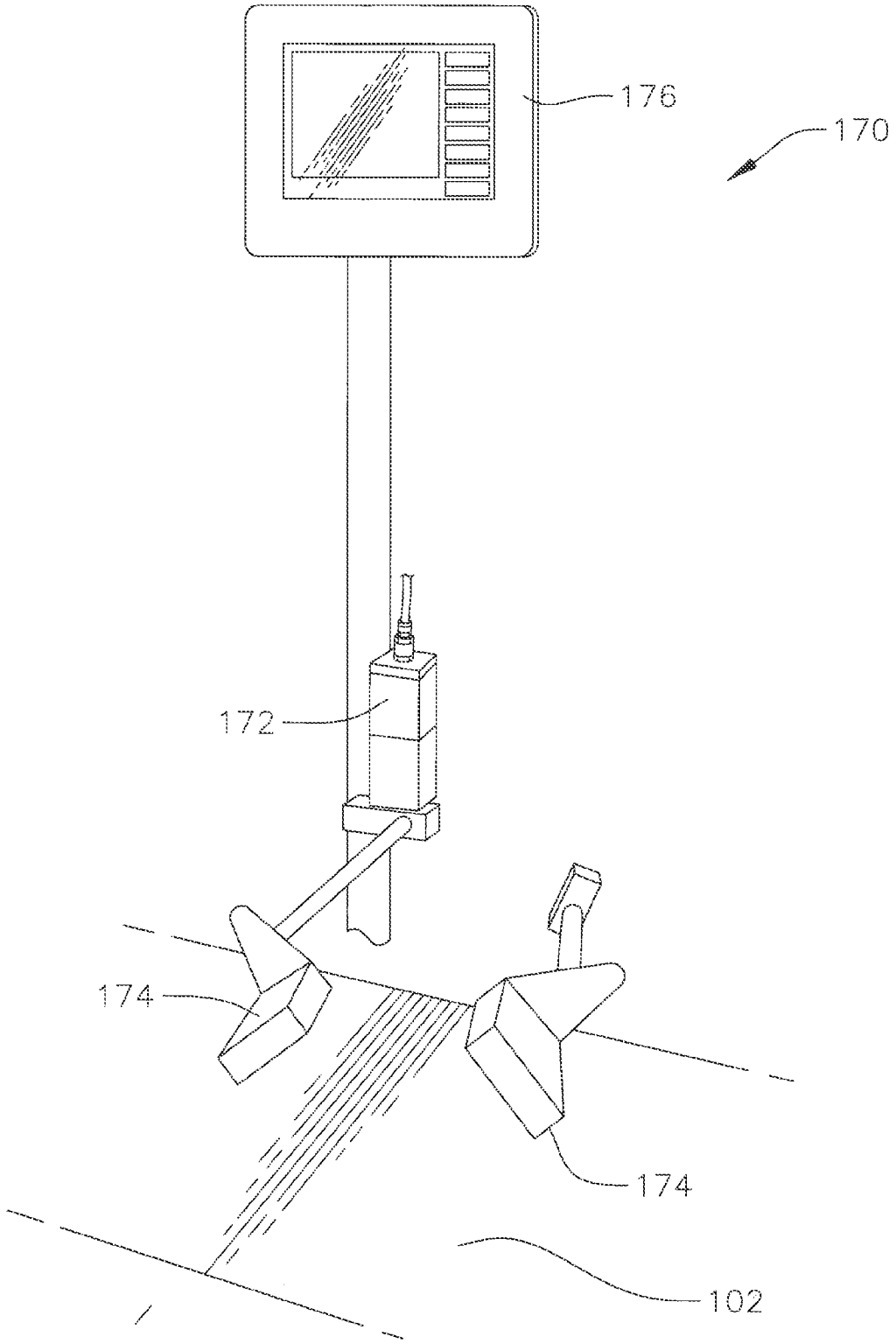
FIG. 8 is a front view of a data capture station of the automated system for constructing card multipacks of FIG. 1, according to an embodiment of the present invention.

With reference to FIG. 8, the data capture station 170, in one embodiment, is configured to read the card bar codes 14*a*, 14*b* from each of the stored value cards 12*a*, 12*b* placed in the first carrier shell 25. The data capture station 170, in one embodiment, includes a camera 172 configured to create an image of the card bar codes 14*a*, 14*b*. In one embodiment, the data capture station 170 further includes at least one illuminating device 174, such as an LED flash, configured to provide illumination on the card bar codes 14*a*, 14*b* when the camera 172 captures the image. In one embodiment, the data capture station 170 is configured to read the card bar codes 14*a*, 14*b* at a location between the card placing stations 130, 140, 150, 160 and the folding station 190.

With further reference to FIG. 8, the data capture station 170, in one embodiment, further includes a computer 176 including a software system adapted to create a data file associating, or linking, each of the card bar codes 14*a*, 14*b* of the stored value cards 12*a*, 12*b*. In one embodiment, the software system creates in the data file an association between the parent card bar code 14*a* and each of the child card bar codes 14*b*. The software system, in one embodiment, creates the data file using the image created by the camera 172. In one embodiment, the data file is used for activating all of the stored value cards 12*a*, 12*b* in the card multipack 10 (e.g., at a time of purchase) using the parent card bar code 14*a* that is readable through the window 22 of the carrier base 20 (e.g., by scanning the parent card bar code 14*a*) due to the association, or linking, of the parent card bar code 14*a* and the child card bar codes 14*b* in the data file.

The third carrier placing station 180 is configured to place a second carrier shell 26 (see FIG. 16) over the stored value cards 12*a*, 12*b* and the first carrier shell 25 before the card multipack 10 is sealed. The third carrier placing station 180, in one embodiment, is configured similar to or the same as the second carrier placing station 120 described above and shown in FIG. 6, and therefore will not be described in further detail.

Figure 17:
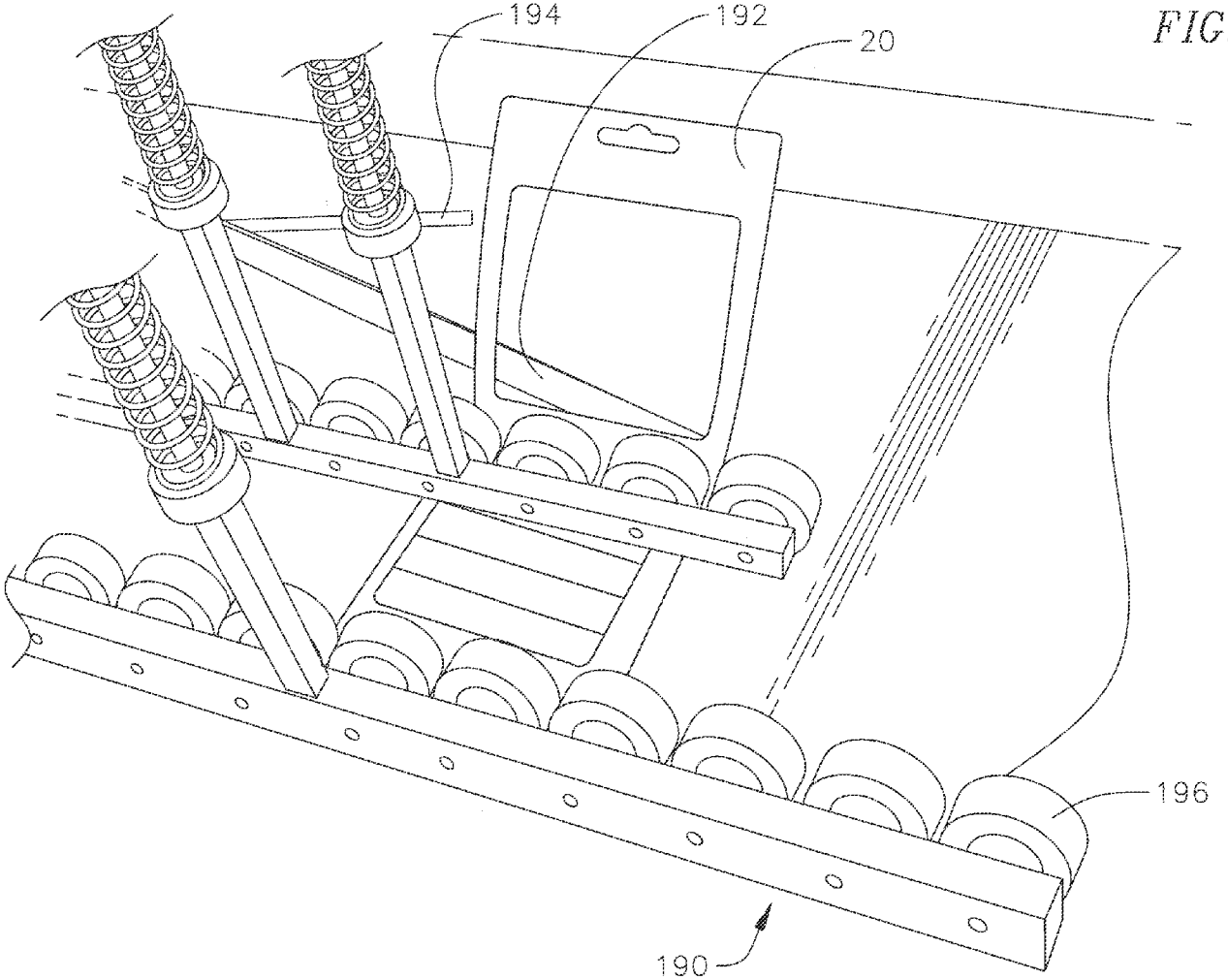
Figure 18:
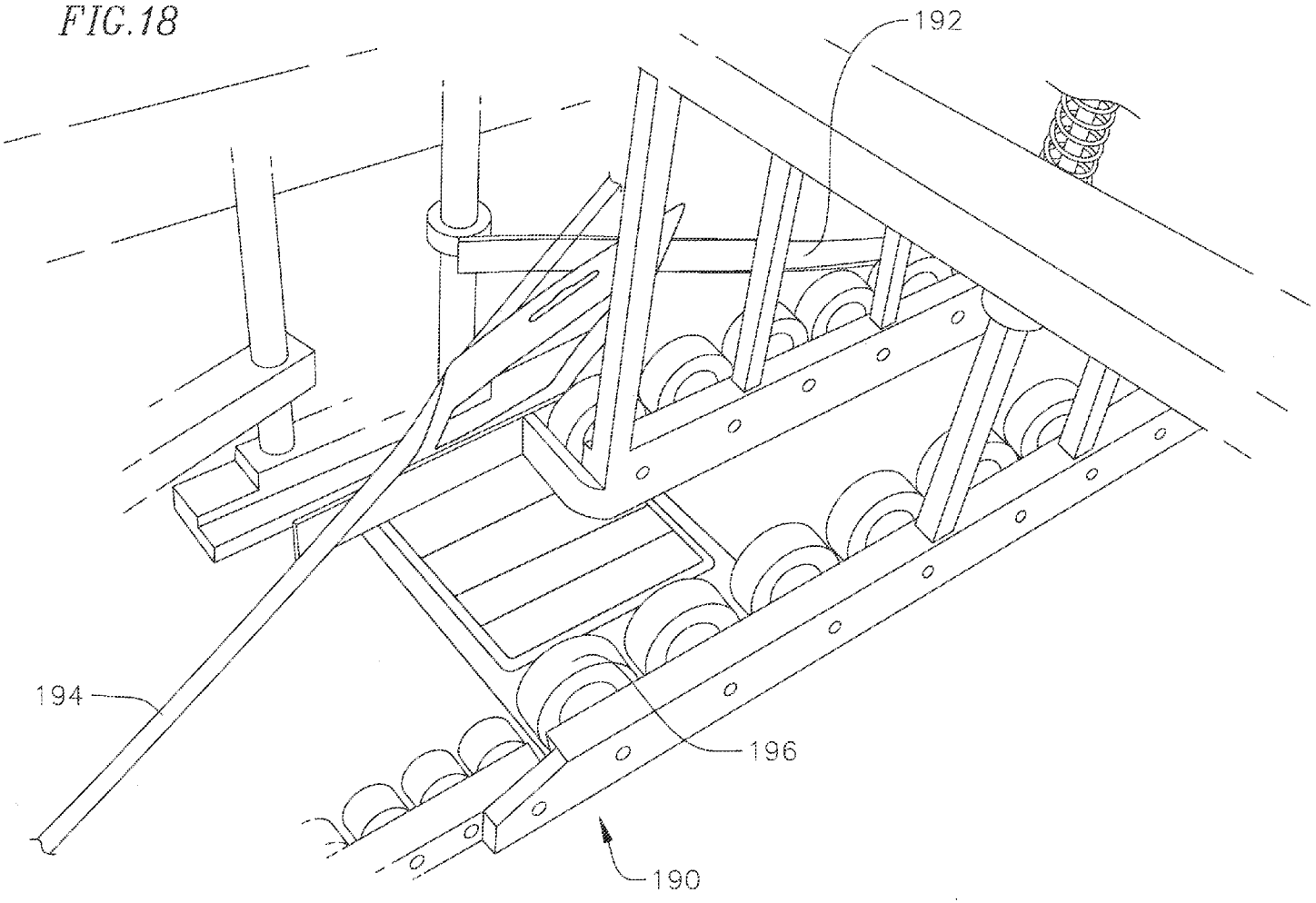
Figure 20:
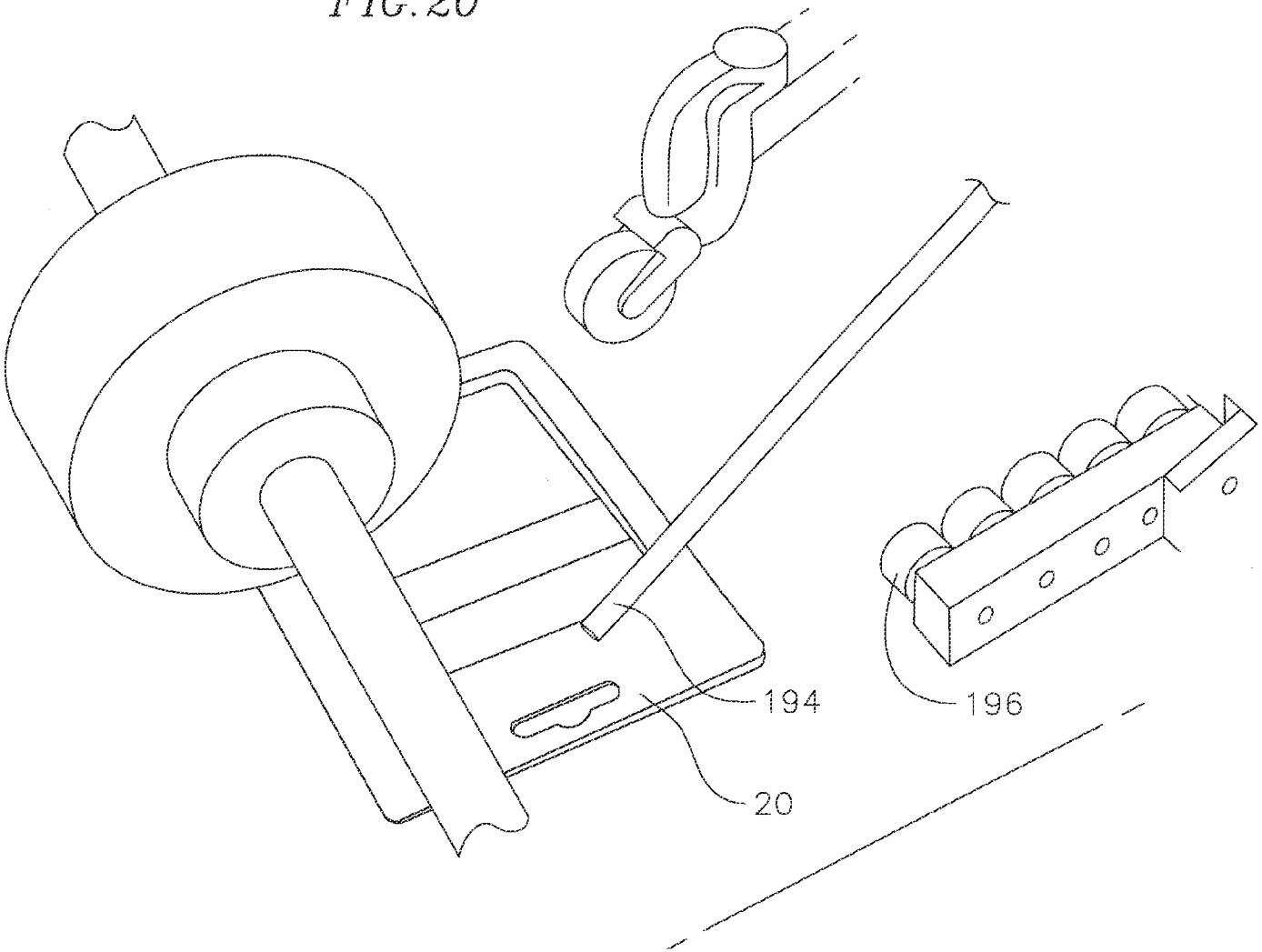

The folding station 190, as shown in FIGS. 17-21, is configured to fold a portion of the carrier base 20 over the first carrier shell 25 and the stored value cards 12*a*, 12*b* for containing the stored value cards 12*a*, 12*b* in the card multipack 10 (e.g., by holding the stored value cards 12*a*, 12*b* in the recessed portion of the first carrier shell 25). The folding station 190, in one embodiment, includes a first folding blade 192 and a second folding blade 194 configured to fold a portion of the carrier base 20, and one or more casters 196 configured to hold another portion of the carrier base 20 flat on the conveyor 102 while the folded portion of the carrier base 20 is folded by the first and second folding blades 192, 194. In one embodiment, for example, the folding station 190 is configured to fold the carrier base 20 at a line near a midline of the carrier base 20 and displace a portion of the carrier base 20 at one side of the folding line onto the portion of the carrier base 20 at the other side of the folding line. In one embodiment, the first folding blade 192 is configured to lift the folded portion of the carrier base 20, as shown in FIG. 17, and the second folding blade 194 is configured to fold the folded portion of the carrier base 20 down onto a remaining portion of the carrier base 20, as shown in FIGS. 18-20.

In one embodiment, the folding station 190 functions as a sealing station for sealing the card multipack 10 with the stored value cards 12*a*, 12*b* inside. The folding station 190, in one embodiment, includes an adhesive dispensing device similar to the adhesive dispensing device 145 described above and shown in FIG. 7 or, alternatively, the system 100 may include an adhesive dispensing device between the third carrier placing station 180 and the folding station 190. In one embodiment, the adhesive dispensing device at or before the folding station 190 is configured to dispense an adhesive on a portion of the carrier base 20 or the second carrier shell 26 such that when the folded portion of the carrier base 20 is folded onto the portion having the adhesive, the carrier base 20 is sealed.

Figure 9:
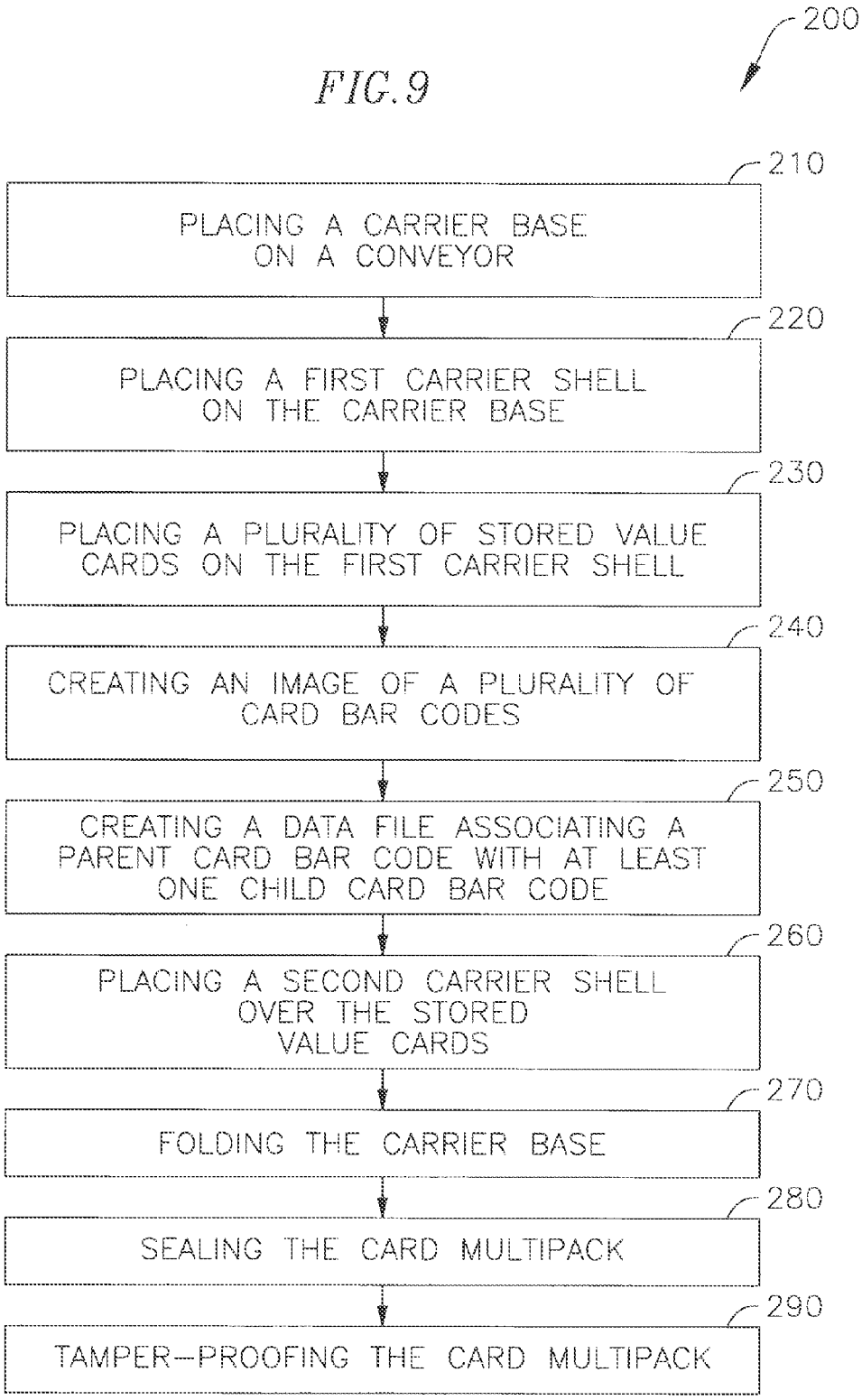
FIG. 9 is a flowchart showing tasks of a method of constructing a card multipack using the automated system for constructing card multipacks of FIG. 1.

With reference to FIG. 9, a method 200 of constructing a card multipack is shown. While the method 200 is described herein with respect to the card multipack 10 and the system 100 for constructing card multipacks described above and shown in FIG. 1, the method 200, or at least some of the tasks thereof, may be performed in constructing card multipacks according to other embodiments of the present invention and/or using an automated system or apparatus for constructing card multipacks according to other embodiments of the present invention, such as those described later herein.

Figure 10:
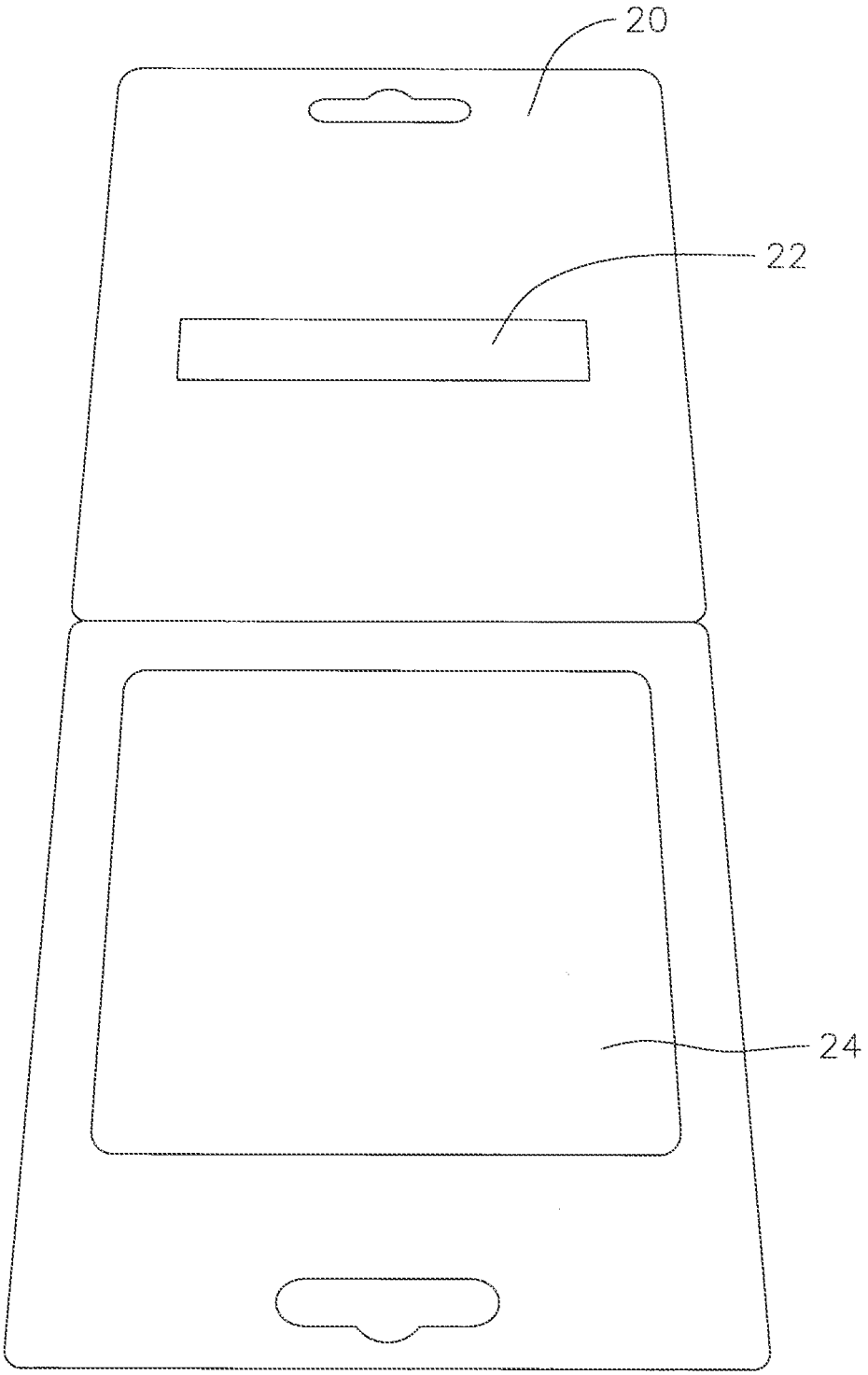
FIG. 10 is a perspective view of a carrier base of a card multipack placed on a conveyer of the automated system for constructing card multipacks of FIG. 1.

With reference to FIG. 10, in one embodiment, the method 200 includes a task 210 of placing a carrier base 20 of the card multipack 10 on the conveyor 102, such as by using the first carrier placing station 110 of the system 100 described above and shown in FIG. 5.

Figure 11:
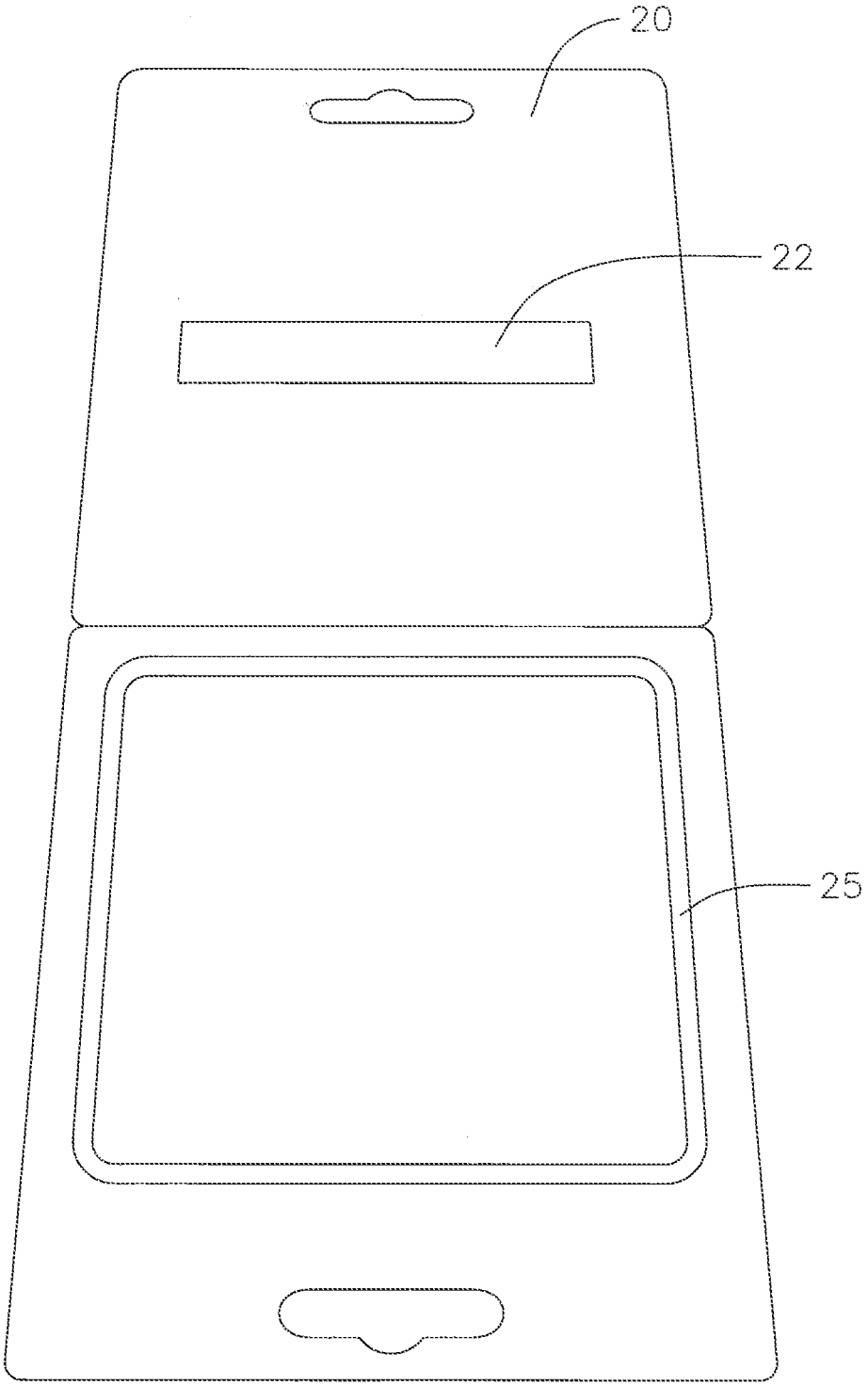
FIG. 11 is a perspective view of a first carrier shell of a card multipack placed on the carrier base of FIG. 10.
Figure 12:
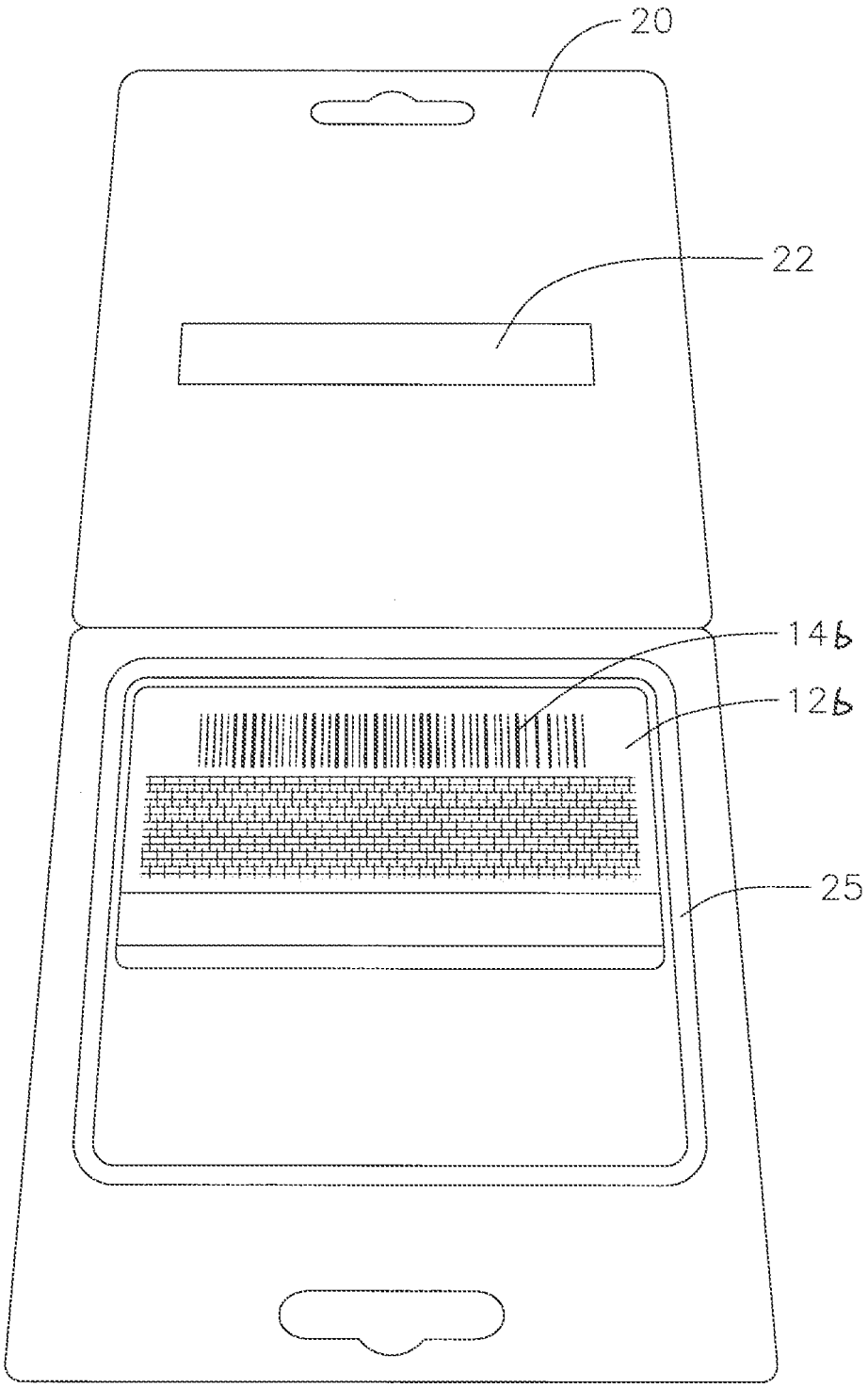
FIGS. 12-15 are perspective views of stored value cards placed on the first carrier shell of FIG. 11.
Figure 13:
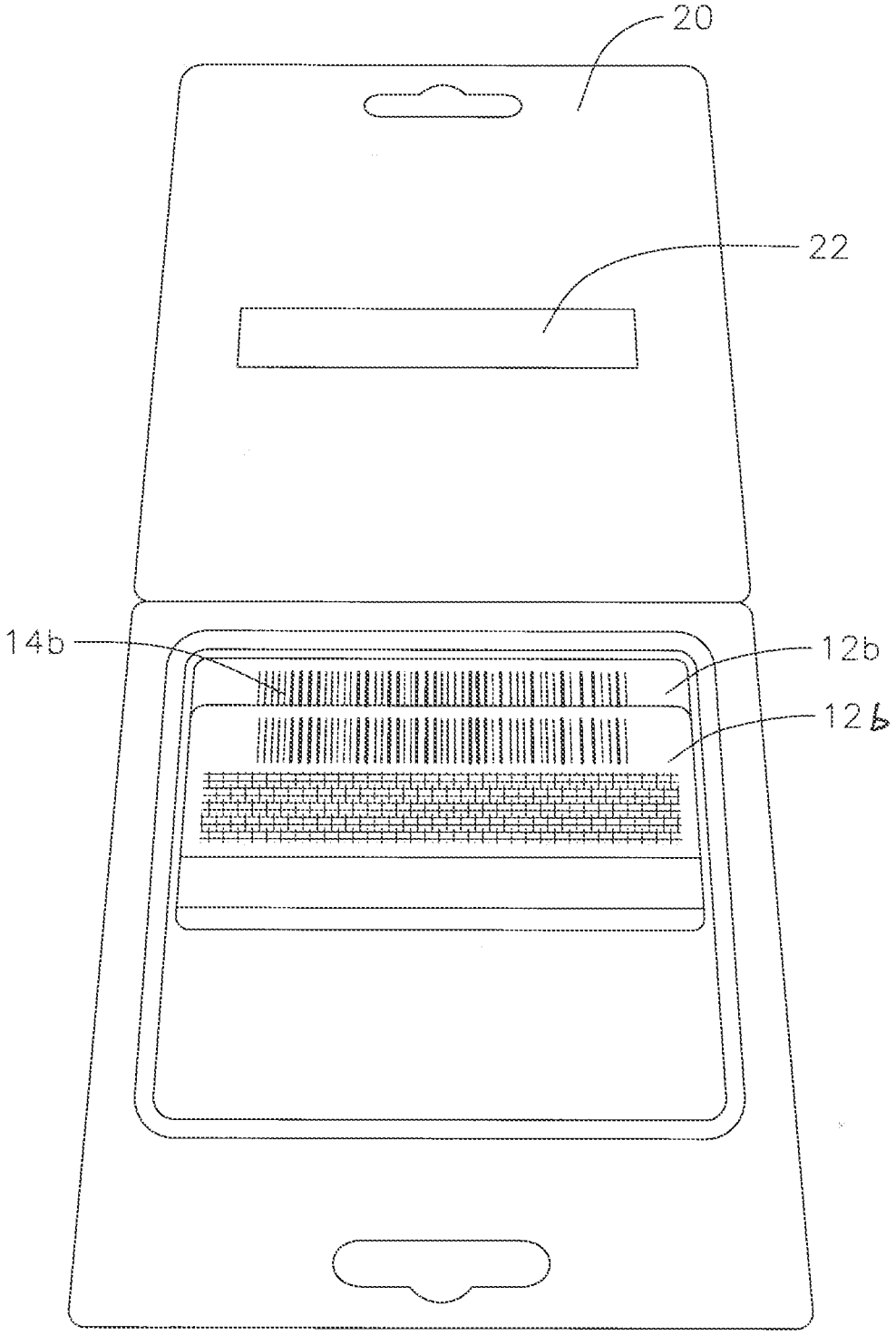
Figure 14:
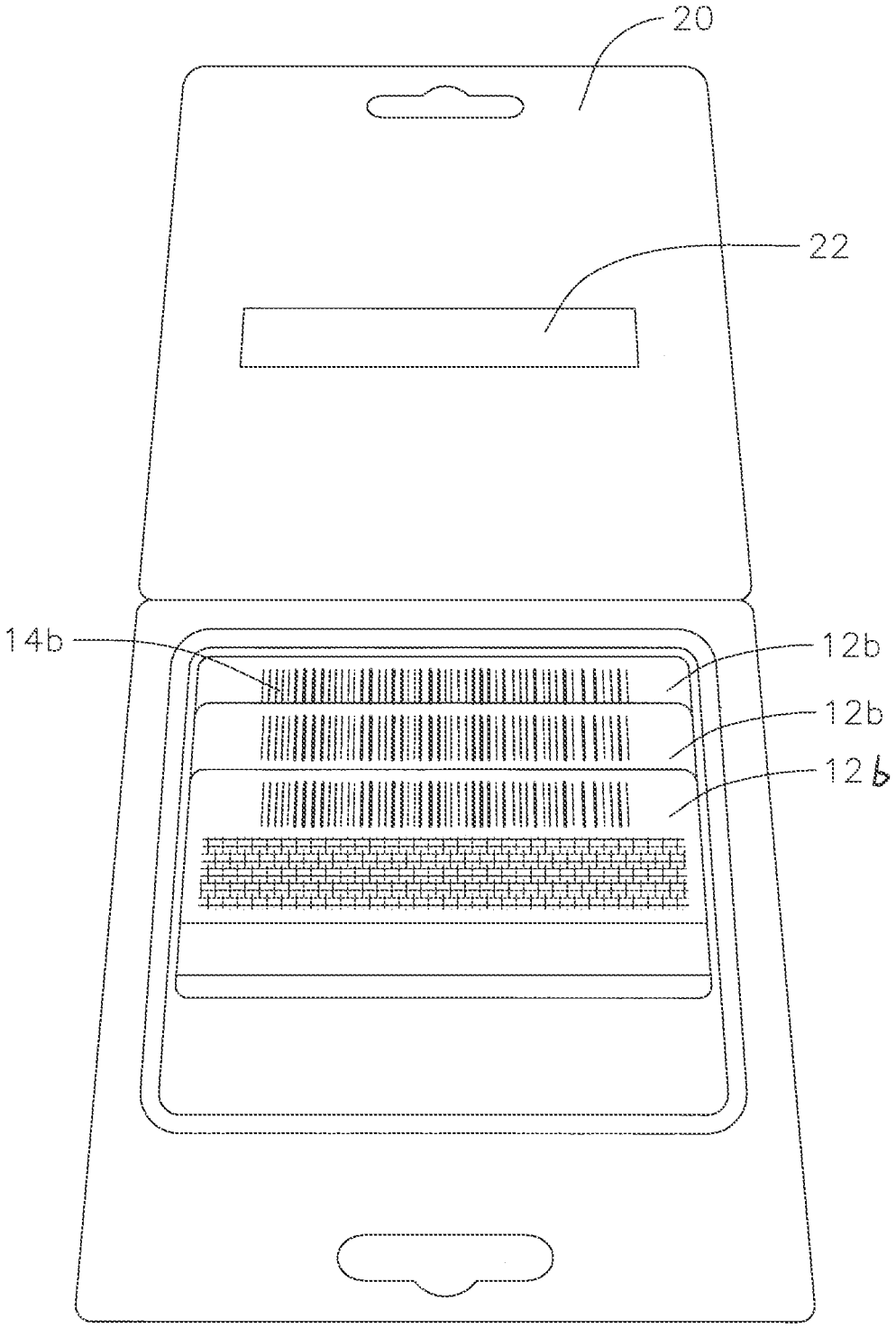
Figure 15:
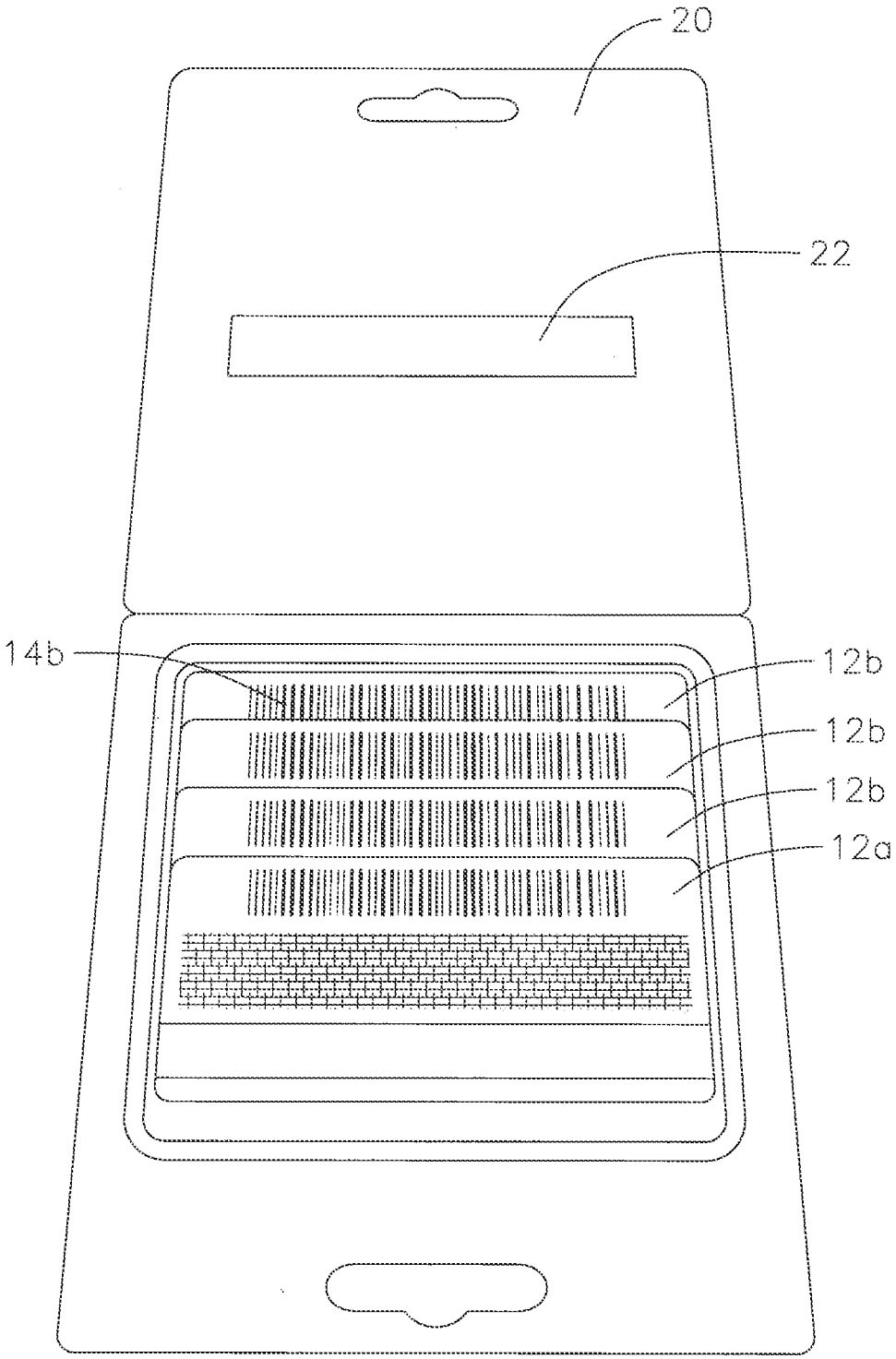

With reference to FIG. 11, the method 200, in one embodiment, further includes a task 220 of placing the first carrier shell 25 on the carrier base 20, such as by using the second carrier placing station 120 of the system 100 described above and shown in FIG. 6. In one embodiment, for example, the carrier base 20 has the opening 24 (see FIG. 10) formed therethrough, and the first carrier shell 25 has a recessed, or cupped portion, and is placed on the carrier base 20 such that the recessed portion protrudes through the opening 24.

With reference to FIGS. 12-15, the method 200, in one embodiment, further includes a task 230 of placing the stored value cards 12*a*, 12*b* in the first carrier shell 25, such as by using the card placing stations 130, 140, 150, 160 of the system 100. In one embodiment, one or more of the child stored value cards 12*b* are placed on the parent stored value cards 12*a*, the child stored value cards 12*b* having the child card bar codes 14*b* that are different from the parent card bar code 14*a* which is readable through the window 22 of the carrier base 20. Alternatively, the stored value cards 12*a*, 12*b* may be stacked in the first carrier shell 25 in any other suitable sequence as long as the parent card bar code 14*a* is readable through the window 22 of the carrier base 20. In one embodiment, an adhesive may be dispensed onto at least one of the stored value cards 12*a*, 12*b*, such as using the adhesive dispensing device 145 described above and shown in FIG. 7, such that the stored value cards 12*a*, 12*b* are held in place in the card multipack 10. In one embodiment, the card bar codes 14*a*, 14*b* may be printed on the stored value cards 12*a*, 12*h* before the stored value cards 12*a*, 12*b* are placed in the first carrier shell 25. Further, the stored value cards 12*a*, 12*b* may be sequentially arranged in the holding rack 132 of the card placing stations 130, 140, 150, 160 according to a predetermined order (e.g., according to a desired range of values of the stored value cards 12*a*, 12*b*). However, in another embodiment, the stored value cards 12*a*, 12*b* may be placed in the first carrier shell 25 in any random order.

In one embodiment, the method 200 further includes a task 240 of creating an image of the card bar codes 14*a*, 14*b* of the stored value cards 12*a*, 12*b*. In one embodiment, the camera 172 of the data capture station 170 is used to create the image of the card bar codes 14*a*, 14*b*. However, the present invention is not limited thereto and, in other embodiments, the image may be created by any other suitable device or method.

The method 200, in one embodiment, further includes a task 250 of creating a data file associating the card bar codes 14*a*, 14*b* with one another. In one embodiment, the data file may be created using the software system of the data capture station 170 described above. That is, the data file, in one embodiment, is built as the card multipacks 10 are packaged by the automated system 100. Further, in one embodiment, the data file may be created using the image from task 240. In one embodiment, in which the stored value cards 12*a*, 12*b* have the stored value card bar codes 14*a*, 14*b* preprinted and are placed in the first carrier shells 25 in a predetermined order, the data file is created according to the predetermined order. In another embodiment, the stored value cards 12*a*, 12*b* have the stored value card bar codes 14*a*, 14*b* preprinted but are placed in the first carrier shells 25 in a random order, and the data file is created according to the random order in which the card multipacks 10 are packaged. In still another embodiment, the stored value cards 12*a*, 12*b* may have the stored value card bar codes 14*a*, 14*b* printed on the stored value cards 12*a*, 12*b* after the card multipacks 10 are on the conveyor 102, either before being input into the data file wherein the data file is subsequently created using the printed stored value card bar codes 14*a*, 14*b*, or after being input into the data file (e.g., a preexisting data file or a data file which is created by the automated system 100 as the card multipacks 10 are being packaged) wherein the stored value card bar codes 14*a*, 14*b* are printed on the stored value cards 12*a*, 12*b* as the data file is created or after the data file has been created.

Figure 16:
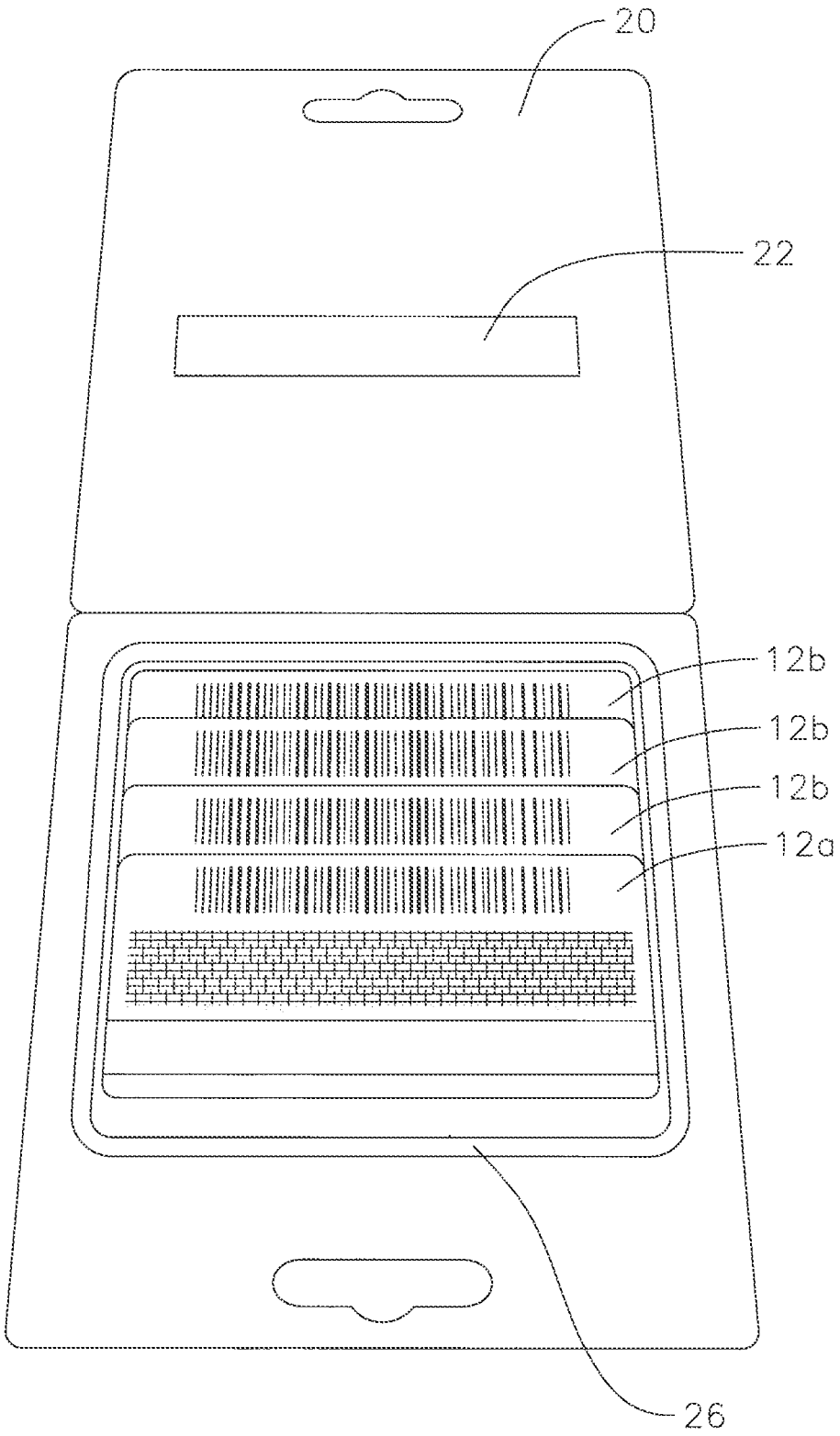
FIG. 16 is a perspective view of a second carrier shell of a card multipack placed over the stored value cards of FIG. 15.

In one embodiment, as shown in FIG. 16, the method 200 further includes a task 260 of placing the second carrier shell 26 over the stored value cards 12*a*, 12*b*, such as using the third carrier placing station 180 of the system 100.

With reference to FIGS. 17-21, the method 200, in one embodiment, further includes a task 270 of folding the carrier base 20, such as by using the folding station 190 of the system 100. As described above, in one embodiment, a first portion of the carrier base 20 is lifted upward by the first folding blade 192 and subsequently folded downward by the second folding blade 194 onto a second portion of the carrier base 20 while the second portion of the carrier base 20 is held on the conveyor 102 by the casters 196. However, the present invention is not limited to the embodiment shown and described above but, rather, in other embodiments, the carrier base 20 may be folded by any other suitable device.

Figure 22:
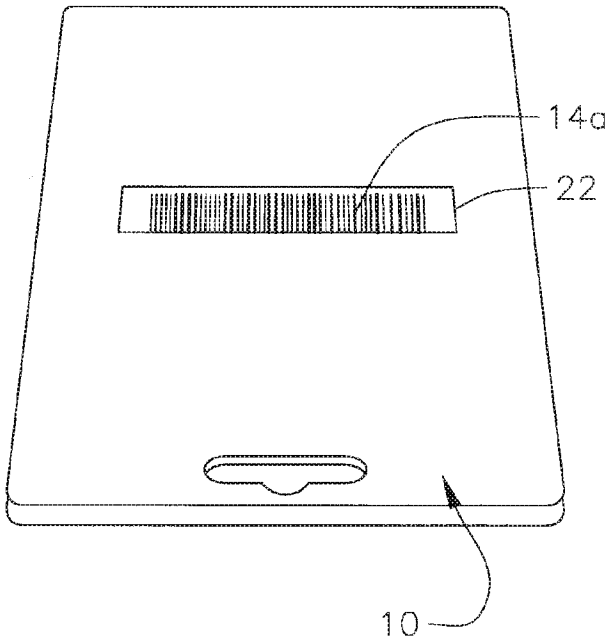
FIG. 22 is a rear perspective view of the folded card multipack of FIG. 21.
Figure 21:
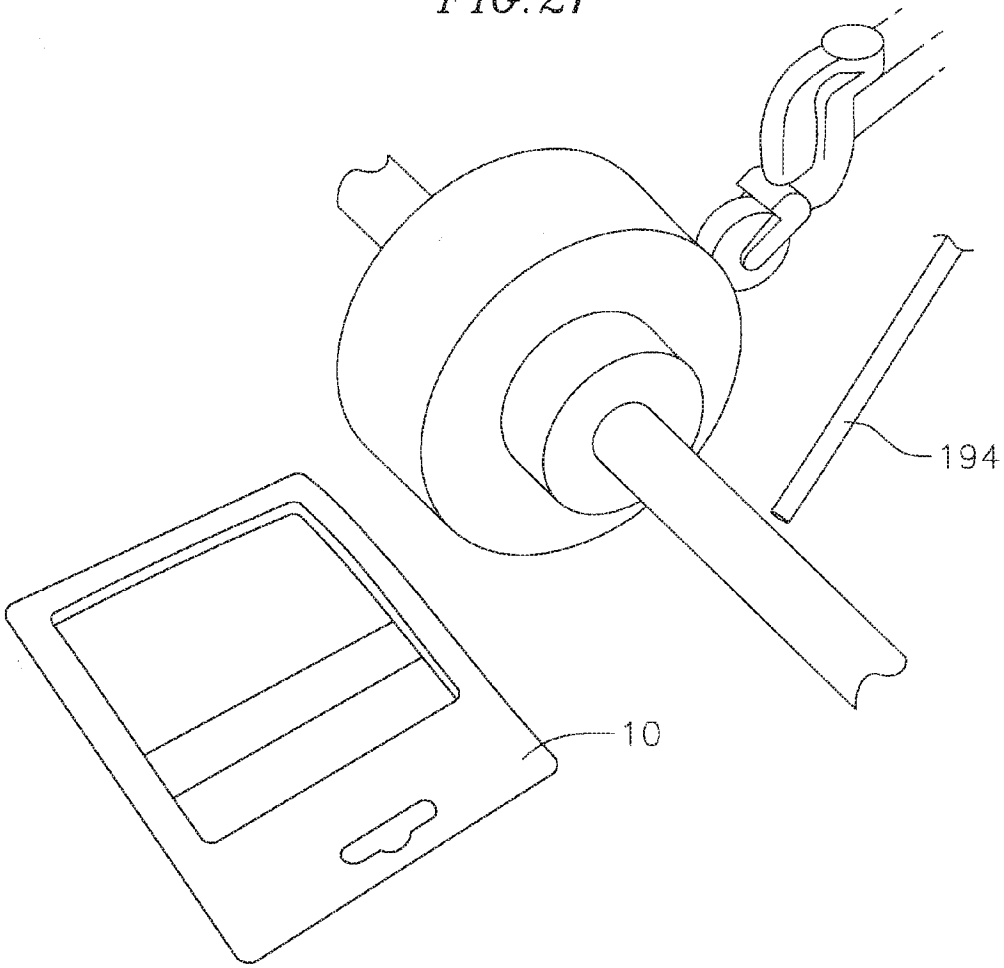

The method 200, in one embodiment, further includes a task 280 of sealing the card multipack 10. The card multipack 10 is shown in FIG. 22 in a sealed state. In one embodiment, an adhesive is applied to a portion of the carrier base 20 prior to being folded in task 270, and the folded portion of the carrier base 20 is folded onto the adhesive such that the carrier base 20, once folded, is also sealed by the adhesive.

In one embodiment, the method 200 further includes a task 290 of tamper-proofing the card multipack 10. With reference to FIG. 1, an apparatus 198 for tamper-proofing the card multipacks 10 is shown. In one embodiment, the apparatus 198 may be used for tamper-proofing a card multipack 10 that has already been sealed using the folding station 190 (e.g., with an adhesive). For example, tamper-proofing may include modifying the sealed card multipack 10 such that the card multipack 10 cannot be opened without visible damage. In another embodiment, the apparatus 198 may be used for sealing (and possibly tamper-proofing also) a card multipack 10 that has merely been folded, but not sealed, using the folding station 190. That is, in one embodiment, the task 280 of sealing the card multipack 10 may be performed using the apparatus 198 rather than the folding station 190.

While in one embodiment, the method 200 of constructing a card multipack may include each of the tasks described above and shown in FIG. 9, in other embodiments of the present invention, in a method of constructing a card multipack, one or more of the tasks described above and shown in FIG. 9 may be absent and/or additional tasks may be performed. Further, in the method 200 of constructing a card multipack according to one embodiment, the tasks may be performed in the order depicted in FIG. 9. However, the present invention is not limited thereto and, in a method of constructing a card multipack according to other embodiments of the present invention, the tasks described above and shown in FIG. 9 may be performed in any other suitable sequence.

Figure 23:
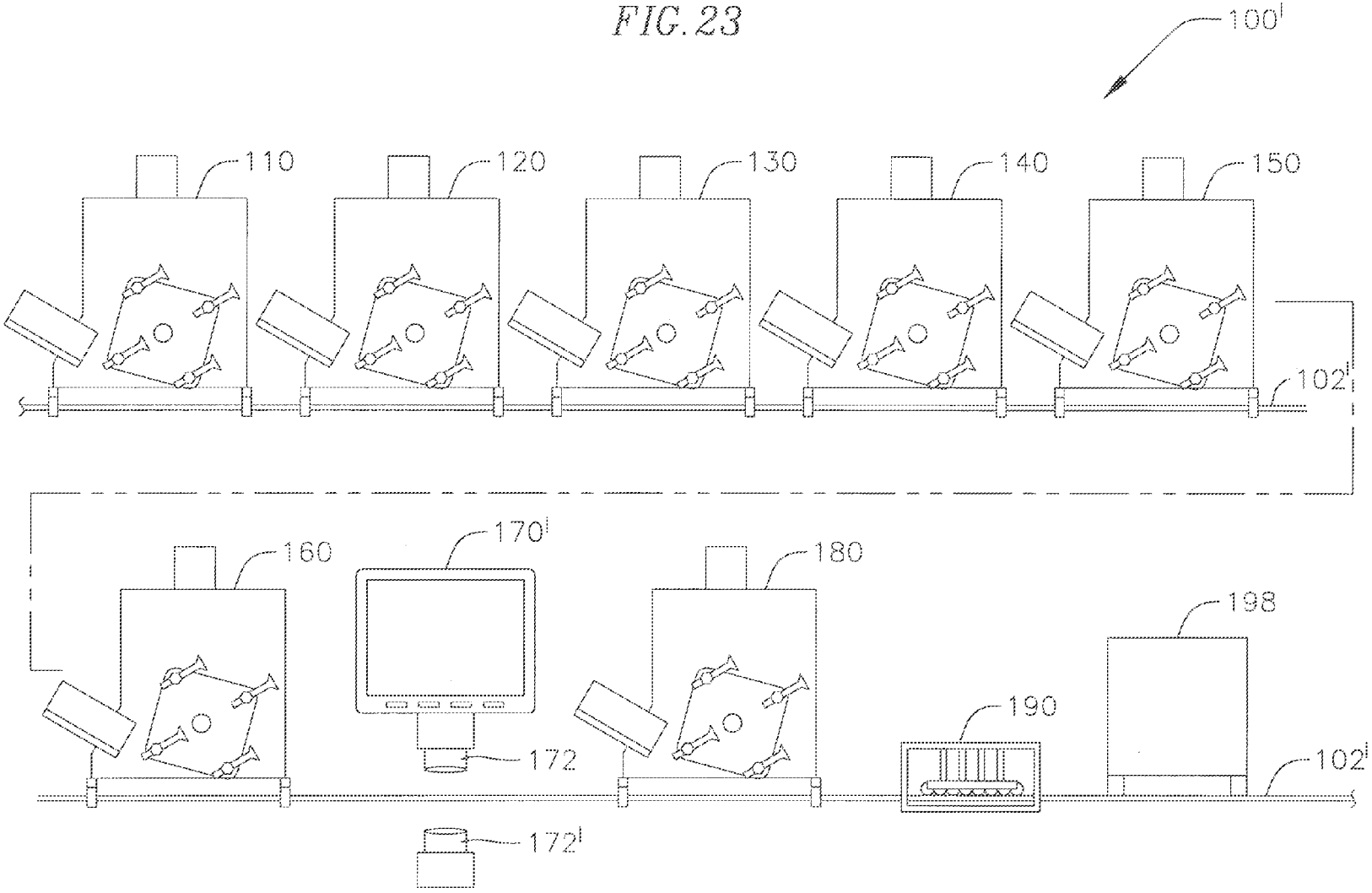
FIG. 23 is a schematic diagram of an automated system for constructing card multipacks according to another embodiment of the present invention.

With reference to FIG. 23, an automated system 100' for constructing card multipacks according to another embodiment of the present invention includes a movable conveyor 102', the first carrier placing station 110, the second carrier placing station 120, the first card placing station 130, the second card placing station 140, the third card placing station 150, the fourth card placing station 160, a data capture station 170', the third carrier placing station 180, the folding station 190, and the sealing/tamper-proofing station 198. The conveyor 102', in one embodiment, is movable between each of the stations and devices shown and described above. Further, in one embodiment, the conveyor 102' is made up of a belt that is driven by a motor but, alternatively, may include any other movable conveying device known in the art.

While the system 100' shown in FIG. 23 including each of the stations and devices described above is one embodiment of the present invention, the present invention is not limited thereto. For example, in other embodiments, one or more of the stations or devices of the system 100' shown in FIG. 23 may be absent and/or additional stations or devices may be added. For example, in one alternative embodiment, the system may have any other desired number of card placing stations rather than four. Also, in constructing a particular card multipack, such as the card multipack shown in FIGS. 26-28 including three stored value cards, one or more of the stations (e.g., one or more of the card placing stations) of the system 100' may not be utilized. Further, while in one embodiment of the present invention, the stations and devices of the system 100' shown in FIG. 23 are arranged in the sequence shown relative to one another, the present invention is not limited thereto. That is, the stations and devices of the system 100' may be arranged in any other suitable sequence relative to one another. For example, in one alternative embodiment, the data capture station 170' may be arranged after the third carrier placing station 180 in the line of the system.

Figure 24:
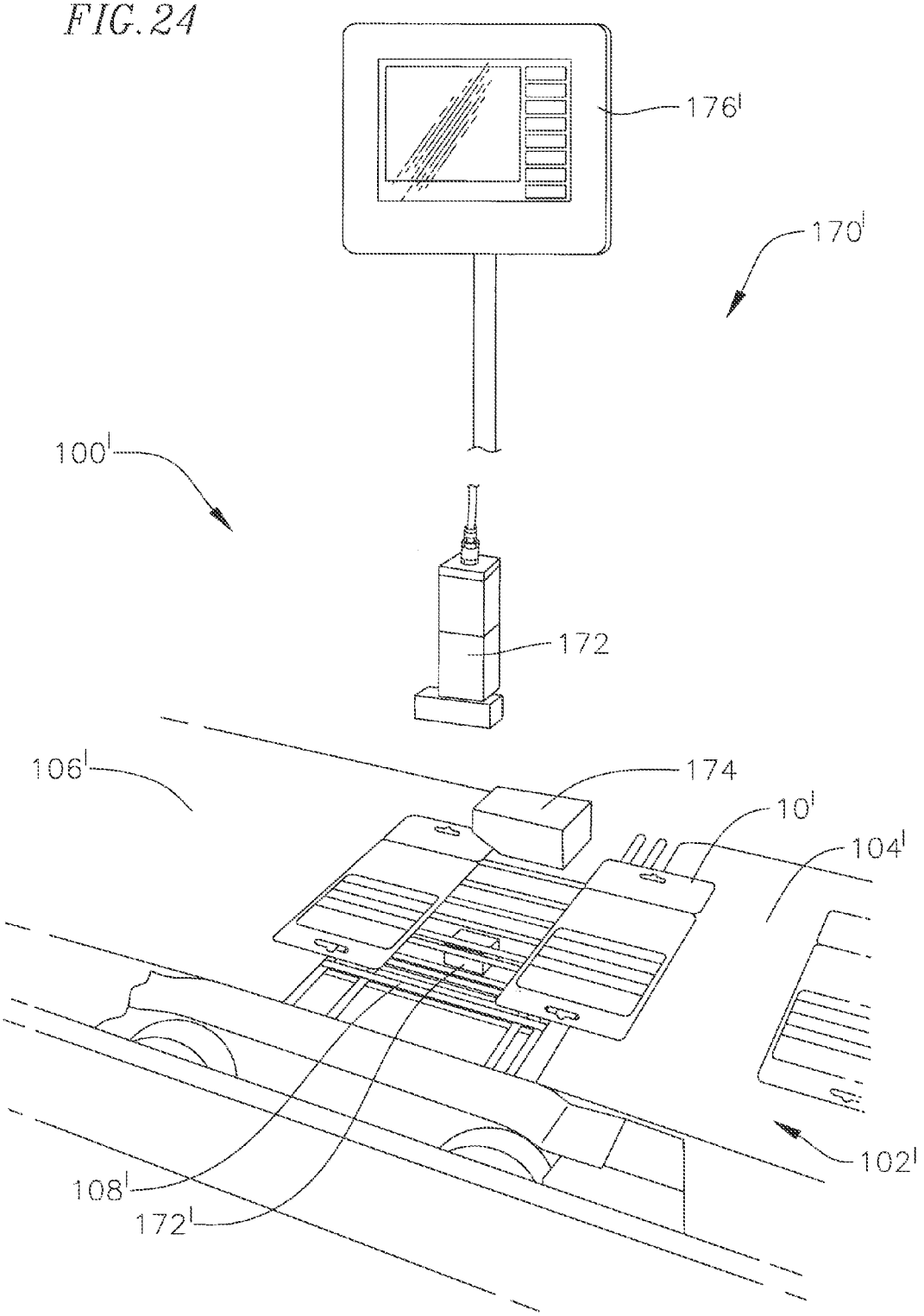
FIG. 24 is a front perspective view of a portion of the automated system for constructing card multipacks of FIG. 23.
Figure 25:
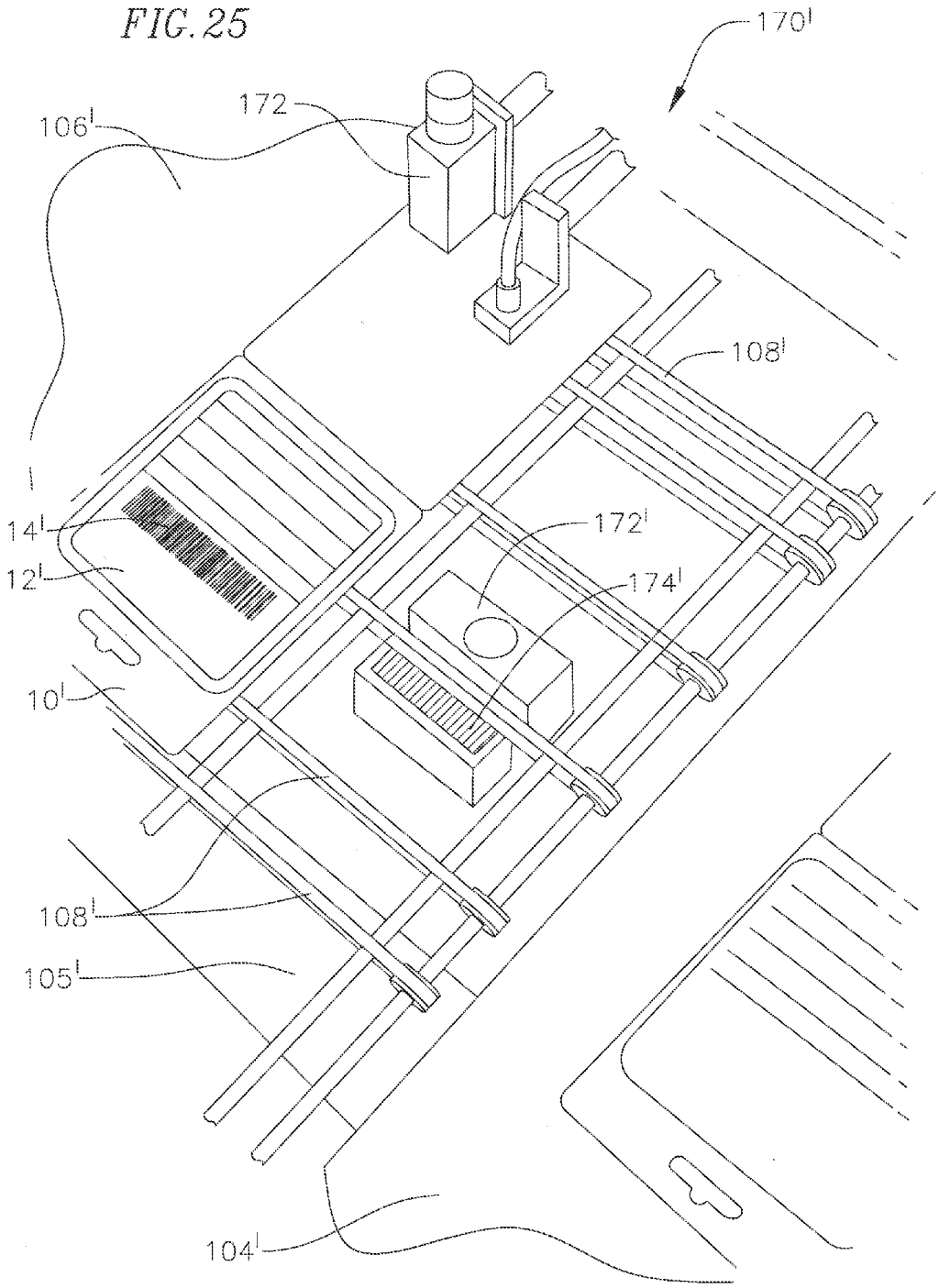
FIG. 25 is a top perspective view of the portion of the automated system for constructing card multipacks shown in FIG. 24.

With reference to FIGS. 23-25, the automated system 100' includes the data capture station 170' including a camera 172' that is located for capturing an image of a carrier bar code 24'. More specifically, the camera 172' of the data capture station 170' is located below the carrier bar code 24' for capturing an image of the carrier bar code 24' facing downward toward the camera 172'. In one embodiment, the data capture station 170' further includes at least one illuminating device 174', such as an LED flash, configured to provide illumination on the carrier bar code 24' when the camera 172' captures the image thereof.

The automated system 100' for constructing card multipack, in one embodiment, includes the movable conveyor 102' configured to move through a first upper region 104', a lower region 105', and a second upper region 106'. The automated system 100' further includes a plurality of belts 108' configured to convey card multipacks 10' from the first upper region 104' to the second upper region 106' of the conveyor 102' across a space above the lower region 105'. The camera 172' and the illuminating device 174' of the data capture station 170' are located below the card multipack 10' between the belts 108' and the lower region 105' of the conveyor 102'. The belts 108' are spaced apart from one another such that at least a portion of the card multipack 10' including the carrier bar code 24' is exposed between the belts 108' and an image of the carrier bar code 24' may be captured by the camera 172' below the card multipack 10' and the belts 108'.

The data capture station 170' further includes the camera 172, described above with respect to the data capture station 170 of the system 100, that is located above the belts 108' and configured to create an image of one or more card bar codes 14' of one or more stored value cards 12' of the card multipack 10'. In one embodiment, the data capture station 170' further includes at least one illuminating device 174, such as an LED flash, configured to provide illumination on the card bar codes 14' when the camera 172 captures the image thereof. The data capture station 170', in one embodiment, further includes a computer 176' including a software system adapted to create a data file associating, or linking, each of the card bar codes 14' of the stored value cards 12' with the carrier bar code 24'. The software system, in one embodiment, creates the data file using the images created by the cameras 172 and 172'. In one embodiment, the data capture station 170' creates a composite image of the images captured by the cameras 172 and 172'. The images or composite image may be shown on a computer screen of the computer 176', such as for verification purposes. For example, the composite image may be shown in a split-screen format. In one embodiment, one or both of the cameras 172, 172' may be made up of a group of cameras. For example, in a multipack including a large number of stored value cards, a single camera (e.g., the camera 172) may not have a large enough field to capture the card bar codes of all of the stored value cards, and, therefore, a group of cameras may be used, each configured to capture an image of some of the card bar codes.

Figure 26:
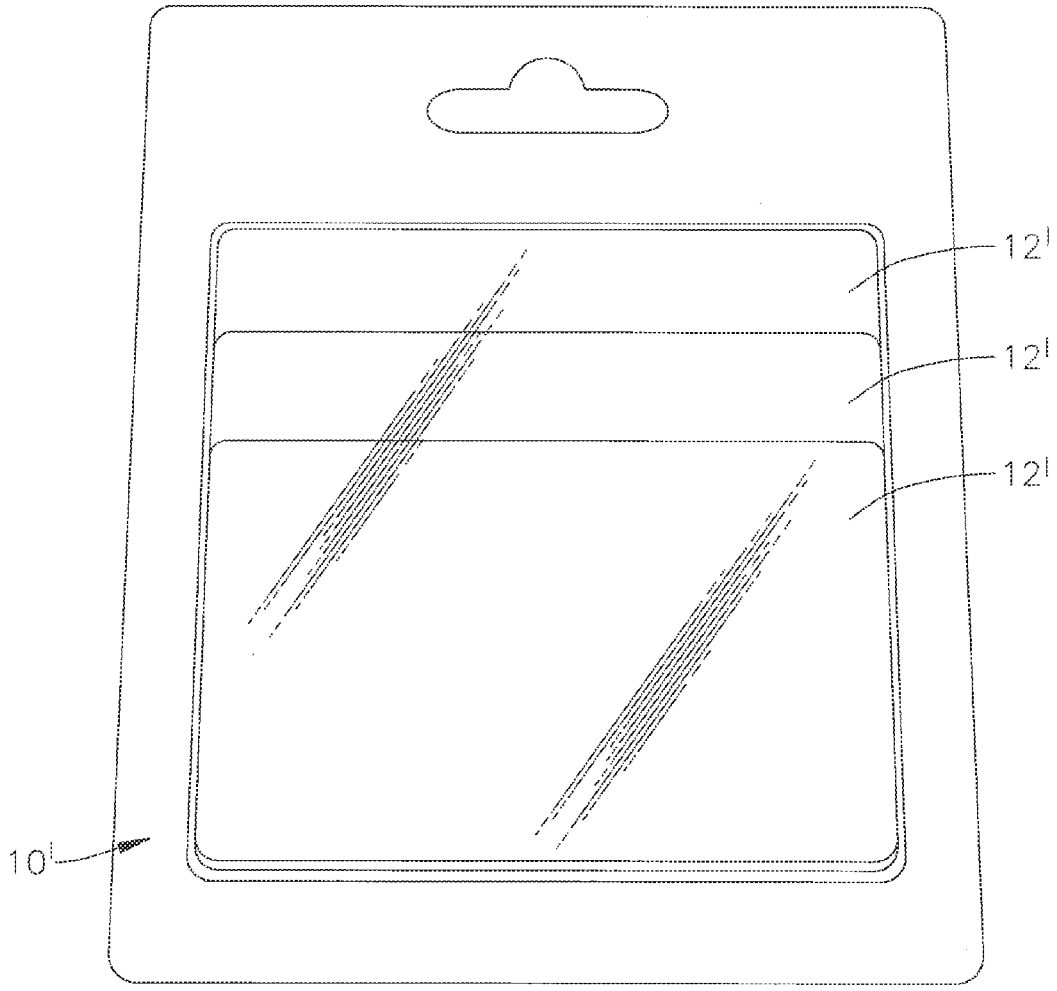
FIG. 26 is a front view of a card multipack constructed using the automated system for constructing card multipacks of FIG. 23, according to an embodiment of the present invention.
Figure 27:
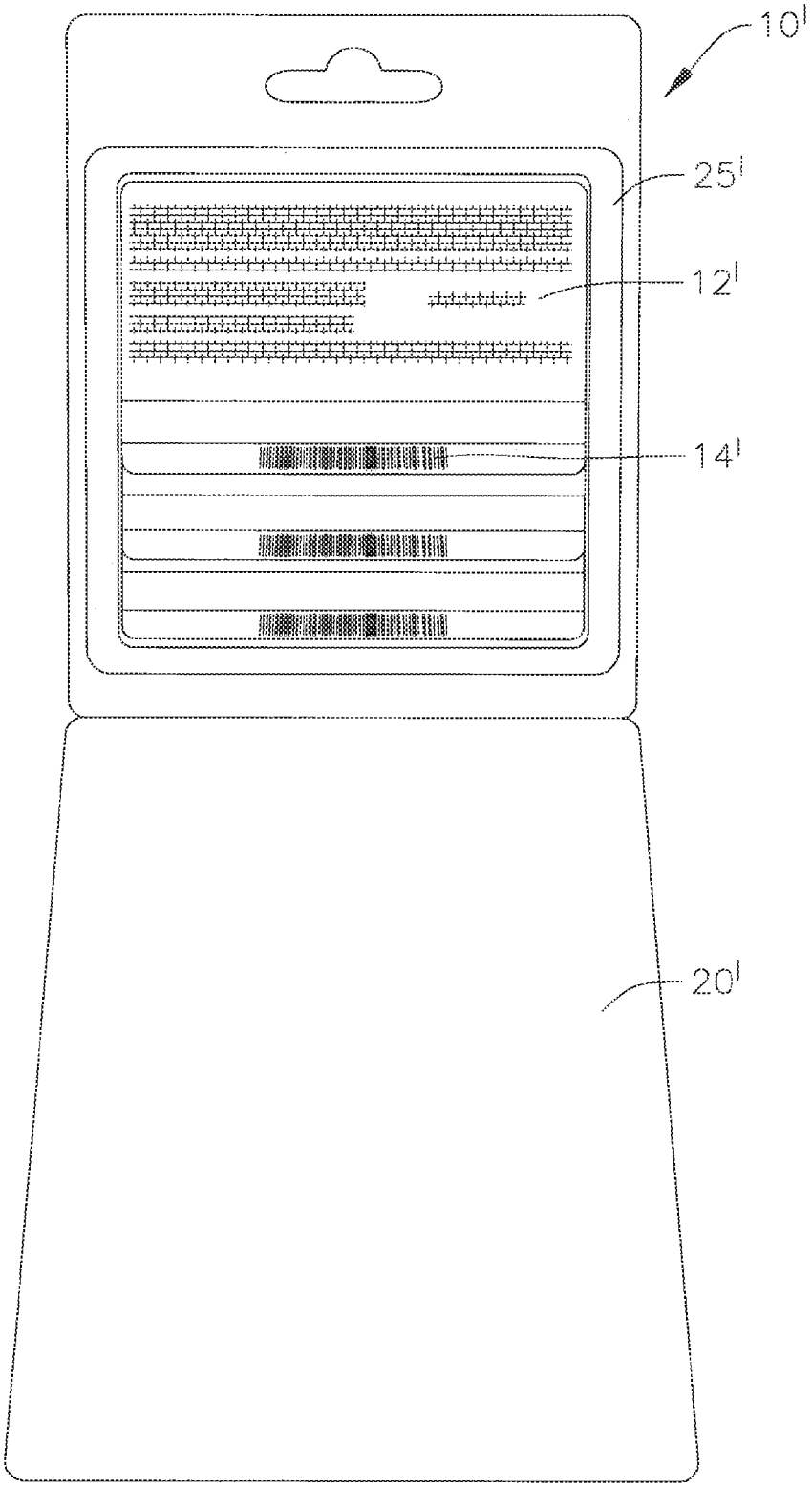
FIG. 27 is a rear view of the card multipack of FIG. 26, shown in an unfolded state.
Figure 28:
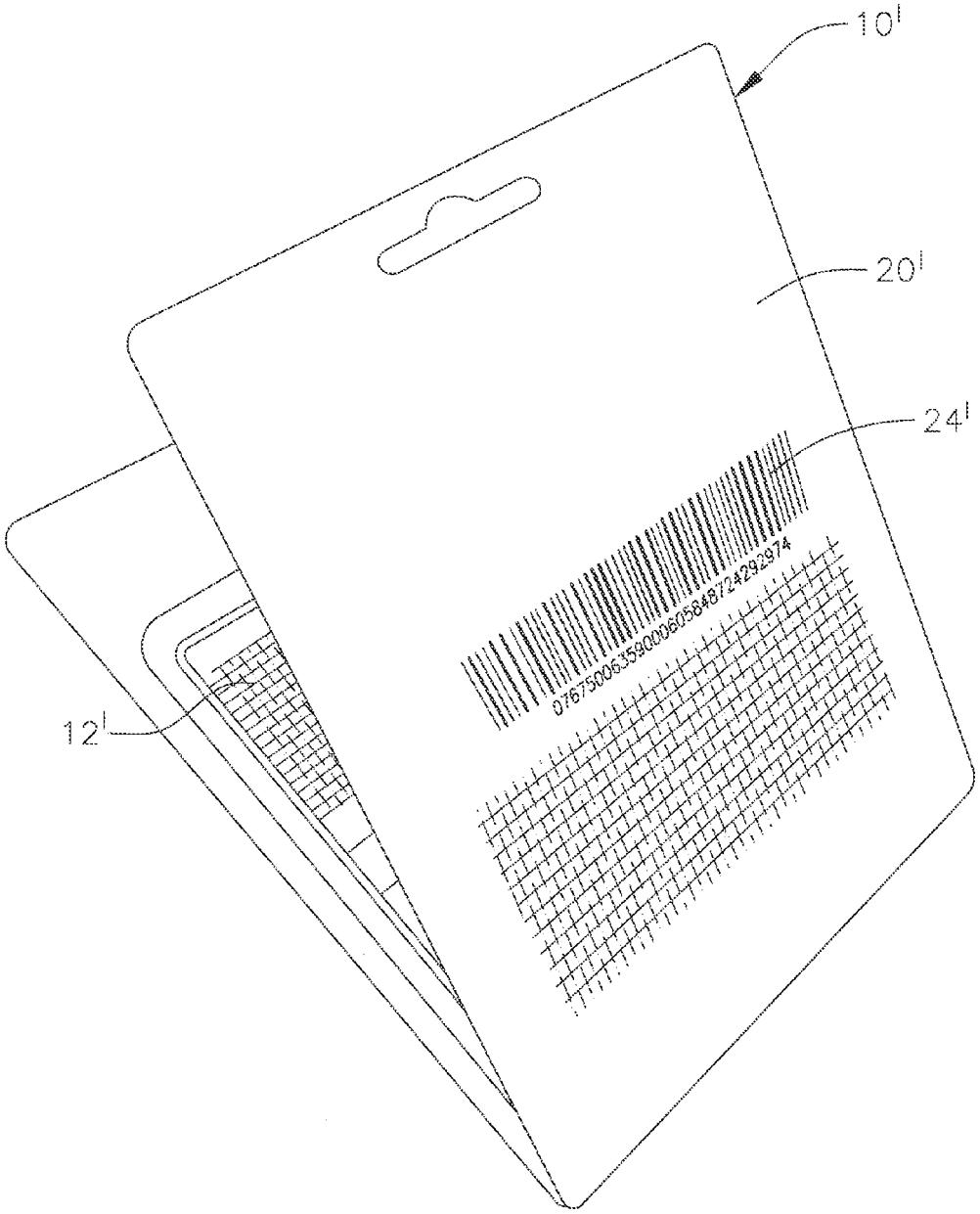
FIG. 28 is a rear view of the card multipack of FIG. 26, shown in an unsealed state.

With reference to FIGS. 26-28, the card multipack 10' according to an embodiment of the present invention is shown. The card multipack 10', for example, may be constructed using the automated system 100'. In FIG. 26, the card multipack 10' is shown in a sealed state containing, for example, three of the stored value cards 12'. However, in other embodiments, the card multipack 10' may include any other desired number of the stored value cards 12', and the automated system 100' may include a suitable corresponding number of the card placing stations. FIG. 27 shows the card multipack 10' in an unfolded state and shows one of the card bar codes 14' on each of the stored value cards 12'. In one embodiment, the card multipack 10' includes a carrier base 20' and a first carrier shell 25' holding the stored value cards 12'. The card multipack 10' may also include a second carrier shell (not shown) placed over the stored value cards 10', similar to the second carrier shell 26 of the card multipack 10 described above. The card multipack 10' is shown in a folded, but unsealed, state in FIG. 28. The carrier base 20' includes the carrier bar code 24' on a surface which, in one embodiment, faces a direction opposite surfaces of the stored value cards 12' having the card bar codes 14' and in which the image of the carrier bar code 24' may be captured by the camera 172'. The carrier bar code 24' is readable, or scannable, and is located on an exterior of the card multipack 10' after the card multipack 10' has been sealed. In one embodiment, as illustrated by FIGS. 27 and 28, the carrier base 20' is folded prior to or during sealing of the card multipack 10', and the carrier bar code 24' is located on an exterior surface of the carrier base 20' after the carrier base 20' has been folded and sealed. Further, in one embodiment, the carrier base 20' may have a window (not shown) similar to the window 22 of the carrier base 20 described above through which one or more of the stored value card bar codes 14' is readable, such as for sequence checking or verification purposes.

Figure 29:
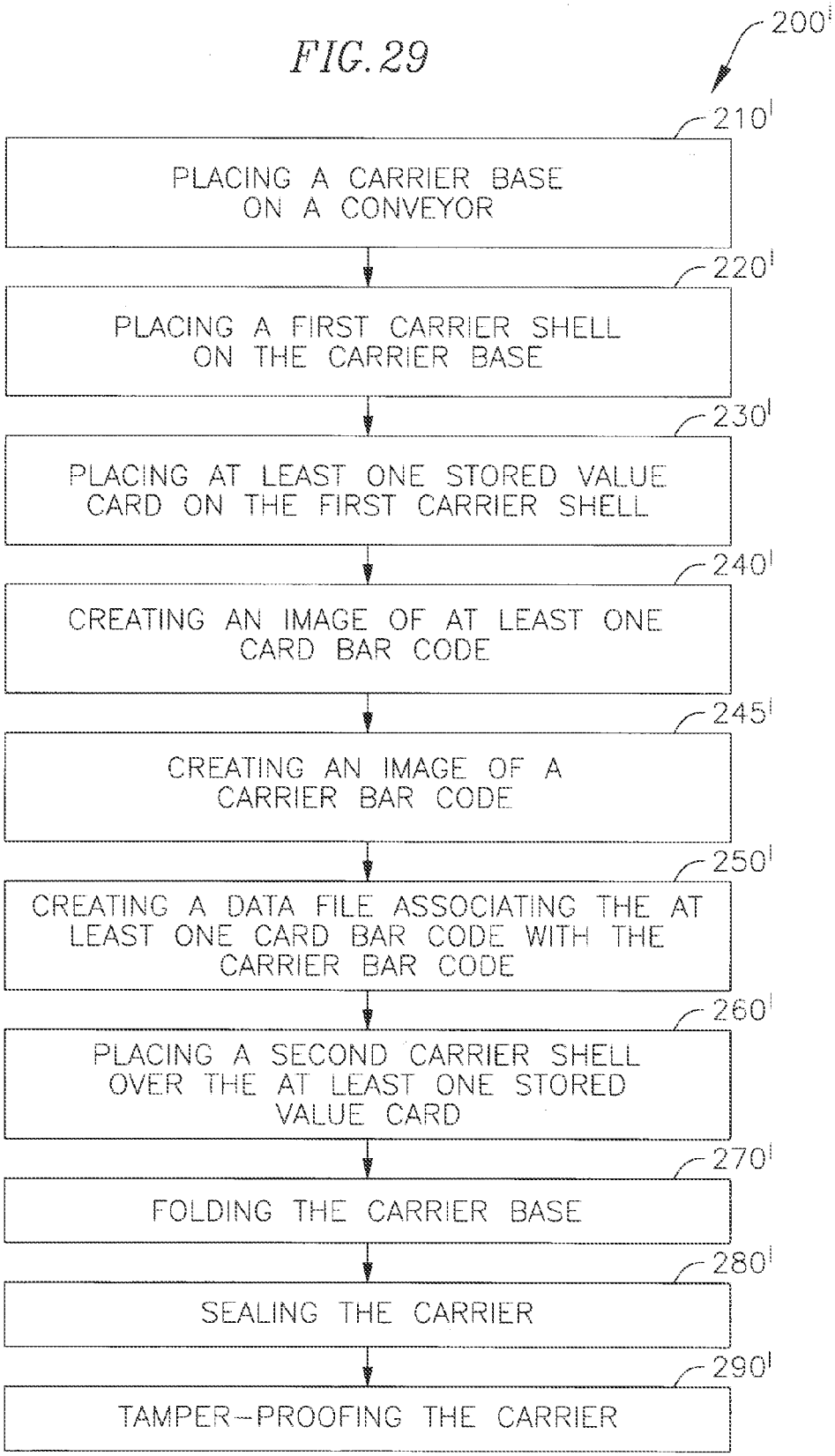
FIG. 29 is a flowchart showing tasks of a method of constructing a card multipack using the automated system for constructing card multipacks of FIG. 23.

With reference to FIG. 29, a method 200' of constructing a card multipack is shown. While the method 200' is described herein with respect to the card multipack 10' and the system 100' for constructing card multipacks described above and shown in FIG. 23, the method 200', or at least some of the tasks thereof, may be performed in constructing card multipacks according to other embodiments of the present invention and/or using an automated system or apparatus for constructing card multipacks according to other embodiments of the present invention.

The method 200' includes a task 210' of placing the carrier base 20' of the card multipack 10' on the conveyor 102', such as by using the first carrier placing station 110 described above with respect to the system 100. In one embodiment, the carrier bar code 24' may be printed on the carrier base 20' before the carrier base 20' is placed on the conveyor 102'. Further, the carrier bases 20' may be sequentially arranged in the holding rack 112 of the carrier placing station 110 according to a predetermined order (e.g., according to a desired range of values of the card multipacks 10'). However, in another embodiment, the carrier bases 20' may be placed on the conveyor 102' in any random order.

The method 200', in one embodiment, further includes a task 220' of placing the first carrier shell 25' on the carrier base 20', such as by using the second carrier placing station 120. In one embodiment, for example, the carrier base 20' has an opening (not shown) formed therethrough, and the first carrier shell 25' has a recessed, or cupped portion, and is placed on the carrier base 20' such that the recessed portion protrudes through the opening. The method 200, in one embodiment, further includes a task 230' of placing one or more of the stored value cards 12' in the first carrier shell 25', such as by using one or more of the card placing stations 130, 140, 150, 160. In one embodiment, an adhesive may be dispensed onto at least one of the stored value cards 12', such as using the adhesive dispensing device 145 described above.

In the method 200' of constructing a card multipack, a task 240' includes creating a first image of the card bar codes 14' of the stored value cards 12' using the camera 172. Further, a task 245' includes creating a second image of the carrier bar code 24' using the camera 172'.

Further, in the method 200' of constructing a card multipack using the automated system 100', a task 250' includes creating a data file associating the card bar codes 14' of the stored value cards 12' with the carrier bar code 24'. That is, a parent/child association is created in the data file where the parent is the carrier bar code 24' and the one or more children are the card bar codes 14'.

In one embodiment, the data file may be created using the software system of the data capture station 170' described above. That is, the data file, in one embodiment, is built as the card multipacks 10' are packaged by the automated system 100' using the images from tasks 240' and 245'.

The method 200' of constructing a card multipack, according to one embodiment, further includes a task 260' of placing a second carrier shell over the stored value cards 12', a task 270' of folding the carrier base 20', a task 280' of sealing the carrier base 20', and a task 290' of tamper-proofing the carrier base 20'. These tasks may be similar to or the same as the respective tasks 260, 270, 280, and 290 of the method 200 described above and, therefore, will not be described in further detail.

Figure 30:
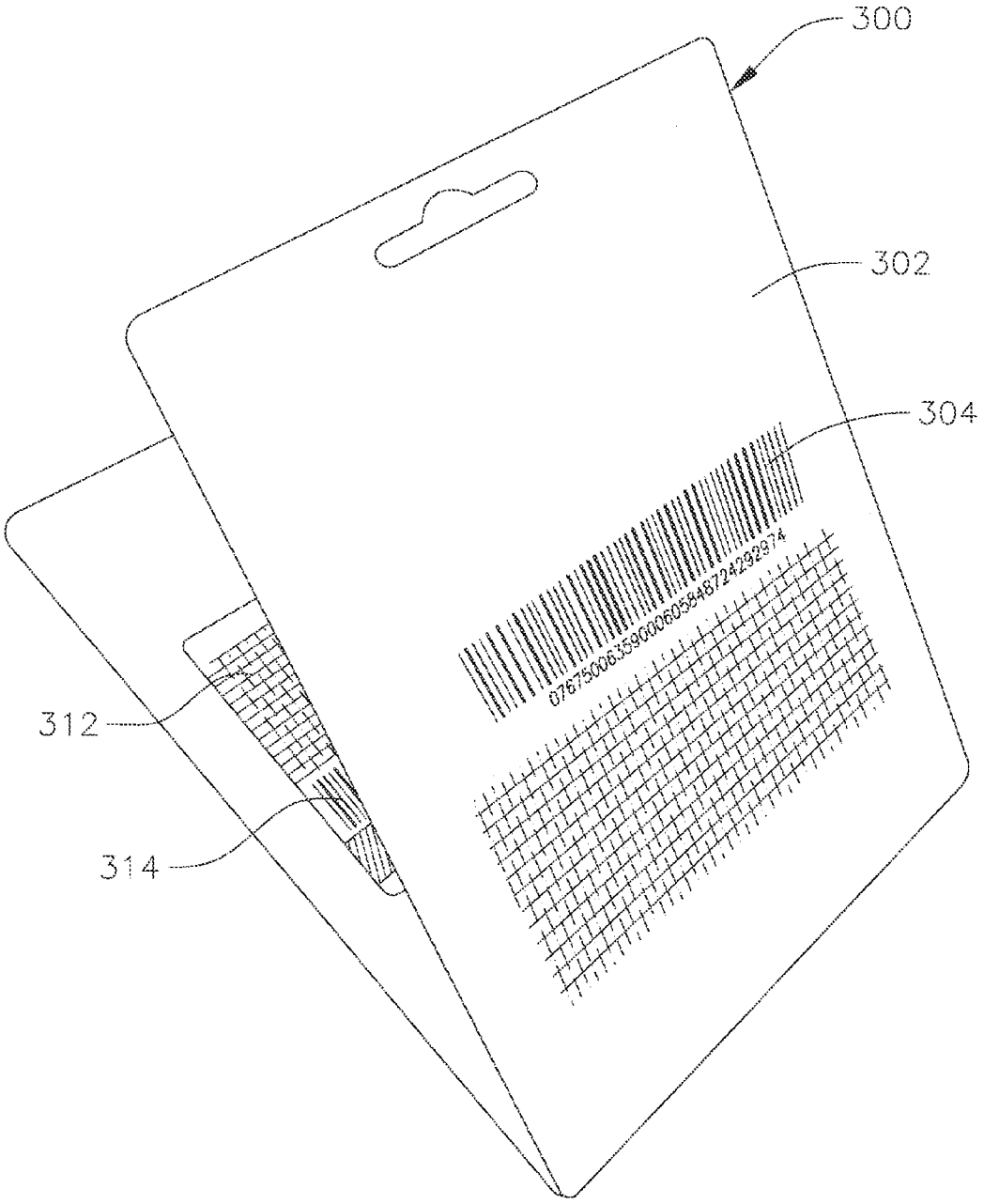
FIG. 30 is a rear view of a card multipack according to another embodiment of the present invention, shown in an unsealed state.

With reference to FIG. 30, a card multipack 300 according to another embodiment of the present invention is shown. The card multipack 300, for example, may be constructed using the automated system 100' described above, although the second and third carrier placing stations 120 and 180 are not needed in constructing the card multipack 300. In FIG. 30, the card multipack 300 is shown in a folded, but unsealed, state and contains one or more stored value cards 312 each having a card bar codes 314. In one embodiment, the card multipack 300 includes a carrier 302 similar to the carrier base 120' described above except that the carrier 302 does not have an opening for receiving a first carrier shell, and neither a first carrier shell nor a second carrier shell is included in the card multipack 300. That is, the stored value cards 312 are placed on the carrier 302. The carrier 302 may be formed of an opaque cardboard material. In one embodiment, the carrier 302 may have a transparent portion (e.g., a cellophane portion) through which the stored value cards 312 are visible. The carrier 302 includes a carrier bar code 304 on a surface which, in one embodiment, faces a direction opposite surfaces of the stored value cards 312 having the card bar codes 314 and in which the image of the carrier bar code 304 may be captured by the camera 172'. The carrier bar code 304 is readable, or scannable, and is located on an exterior of the card multipack 300 after the card multipack 300 has been sealed. In one embodiment, the carrier 302 is folded prior to or during sealing of the card multipack 300, and the carrier bar code 304 is located on an exterior surface of the carrier 302 after the carrier 302 has been folded and sealed. Further, in one embodiment, the carrier 302 may have a window (not shown) similar to the window 22 of the carrier base 20 described above through which one or more of the stored value card bar codes 314 is readable, such as for sequence checking or verification purposes.

Figure 31:
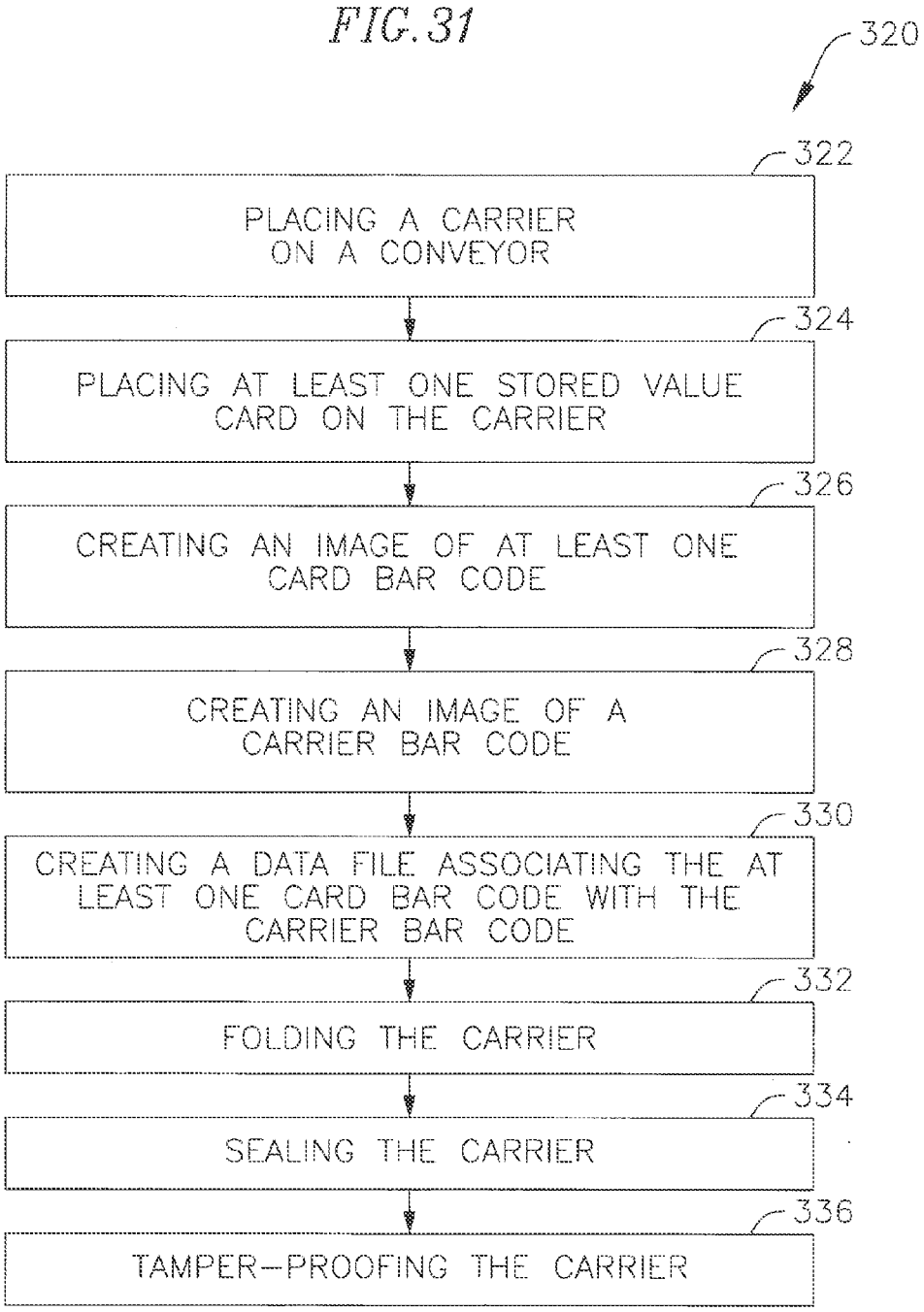
FIG. 31 is a flowchart showing tasks of a method of constructing a card multipack using an automated system according to another embodiment of the present invention.

With reference to FIG. 31, a method 320 of constructing a card multipack is shown. The method 320, in one embodiment, may be performed in constructing the card multipack 300 using the system 100' for constructing card multipacks described above and shown in FIG. 23. However, in other embodiments, the method 320, or at least some of the tasks thereof, may be performed in constructing card multipacks according to other embodiments of the present invention and/or using an automated system or apparatus for constructing card multipacks according to other embodiments of the present invention.

The method 320 includes a task 322 of placing the carrier 302 of the card multipack 300 on the conveyor 102', such as by using the first carrier placing station 110. In one embodiment, the carrier bar code 304 may be printed on the carrier 302 before the carrier 302 is placed on the conveyor 102'. Further, the carriers 302 may be sequentially arranged in the holding rack 112 of the carrier placing station 110 according to a predetermined order (e.g., according to a desired range of values of the card multipacks 300). However, in another embodiment, the carriers 302 may be placed on the conveyor 102' in any random order.

The method 320 further includes a task 324 of placing one or more of the stored value cards 312 on the carrier 302, such as by using one or more of the card placing stations 130, 140, 150, 160. In one embodiment, an adhesive may be dispensed onto at least one of the stored value cards 312, such as using the adhesive dispensing device 145 described above.

In the method 320 of constructing a card multipack, a task 326 of creating a first image of the card bar codes 314 of the stored value cards 312 using the camera 172, a task 328 of creating a second image of the carrier bar code 304 using the camera 172', and a task 330 of creating a data file associating the card bar codes 314 of the stored value cards 312 with the carrier bar code 304 are the same or similar to the respective tasks 240', 245', and 250' of the method 200' described above and, therefore, will not be described in further detail.

The method 320 of constructing a card multipack, according to one embodiment, further includes a task 332 of folding the carrier 302, a task 334 of sealing the carrier 302, and a task 336 of tamper-proofing the carrier 302. These tasks may be similar to or the same as the respective tasks 270', 280', and 290' of the method 200' described above and, therefore, will not be described in further detail.

Figure 32:
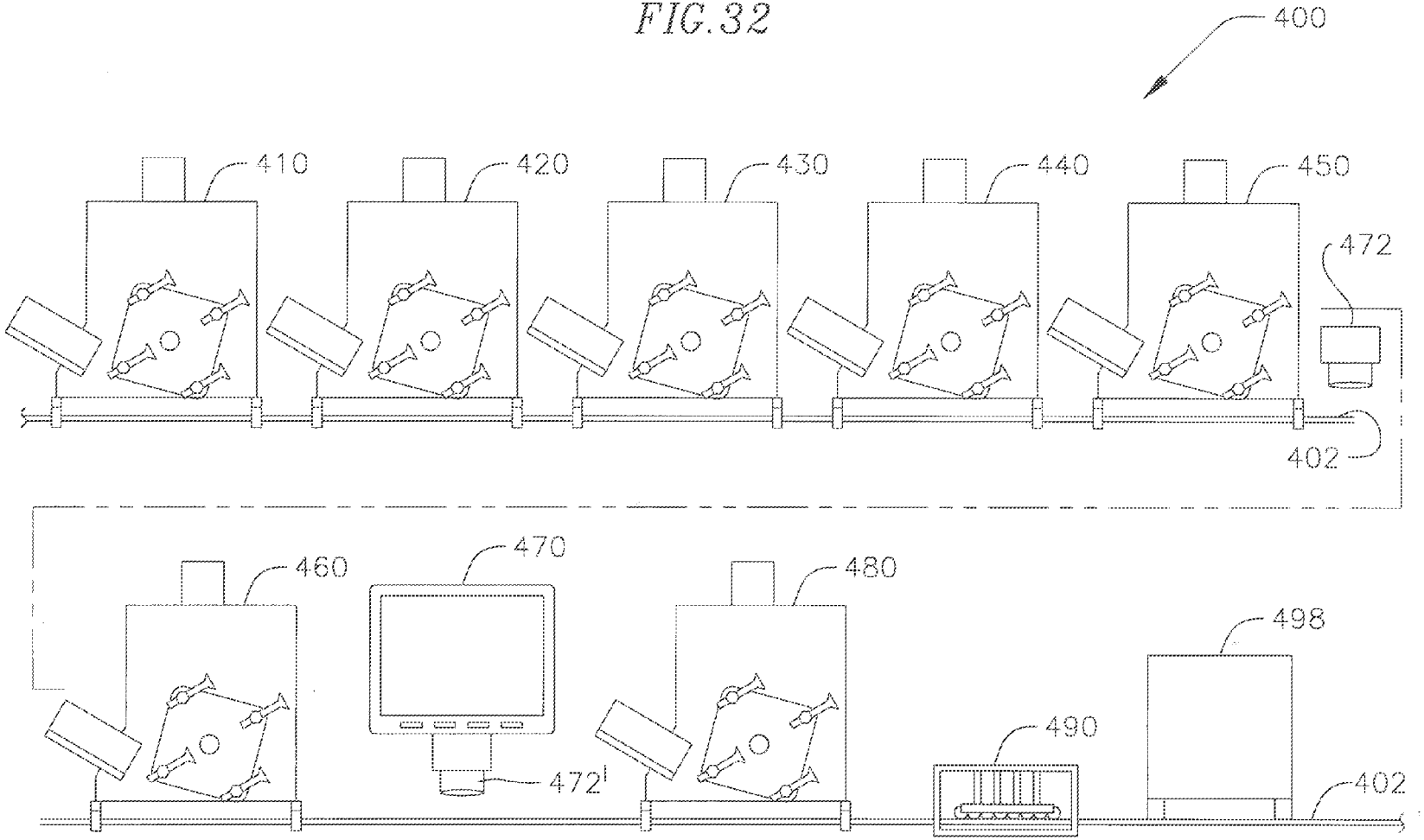
FIG. 32 is a schematic diagram of an automated system for constructing card multipacks according to another embodiment of the present invention.

With reference to FIG. 32, an automated system 400 for constructing card multipacks according to another embodiment of the present invention includes a movable conveyor 402, a first carrier placing station 410, a first card placing station 420, a second card placing station 430, a third card placing station 440, a fourth card placing station 450, a second carrier placing station 460, a data capture station 470, a third carrier placing station 480, a sealing station 490, and a tamper-proofing station 498. The conveyor 402, in one embodiment, is movable between each of the stations and devices shown and described above. Further, in one embodiment, the conveyor 402 is made up of a belt that is driven by a motor but, alternatively, may include any other movable conveying device known in the art. In one embodiment, sealing and tamper-proofing of card multipacks may be performed at a single station in the automated system 400.

While the system 400 shown in FIG. 32 including each of the stations and devices described above is one embodiment of the present invention, the present invention is not limited thereto. For example, in other embodiments, one or more of the stations or devices of the system 400 shown in FIG. 32 may be absent and/or additional stations or devices may be added. For example, in one alternative embodiment, the system may have any other desired number of card placing stations rather than four. Also, in constructing a particular card multipack, such as the card multipack shown in FIG. 33 including three stored value cards, one or more of the stations (e.g., one or more of the card placing stations) of the system 400 may not be utilized. Further, while in one embodiment of the present invention, the stations and devices of the system 400 shown in FIG. 32 are arranged in the sequence shown relative to one another, the present invention is not limited thereto. That is, the stations and devices of the system 400 may be arranged in any other suitable sequence relative to one another.

With reference to FIG. 32, the automated system 400 includes the data capture station 470 including a camera 472 configured to create an image of one or more card bar codes 514 of one or more stored value cards 512 of a card multipack 500. In one embodiment, the data capture station 470 further includes at least one illuminating device (not shown), such as an LED flash, configured to provide illumination on the card bar codes 514 when the camera 472 captures the image thereof. The data capture station 470 further includes a camera 472 that is located for capturing an image of a carrier bar code 516 of the card multipack 500. In one embodiment, the data capture station 470 further includes at least one illuminating device (not shown), such as an LED flash, configured to provide illumination on the carrier bar code 516 when the camera 472' captures the image thereof.

As depicted in FIG. 32, the camera 472 of the data capture station 470 is located between the card placing stations 420, 430, 440, 450 and the second carrier placing station 460 in the in-line system 400 for capturing an image of the card bar codes 514, and the camera 472' is located after the second carrier placing station 460 in the in-line system 400 for capturing an image of the carrier bar code 516. Because the cameras 472 and 472' are at different locations in-line in the system 400, the system 400 is configured to associate the card bar codes 514, an image of which is captured by the camera 472, with the carrier bar code 516, an image of which is subsequently captured by the camera 472'. In one embodiment, the system 400 verifies the association via a sensor (not shown) which counts the card multipacks 500 travelling past the sensor on the conveyor 402. In another embodiment, the association may be verified by a sequence number of one or more of the stored value cards 512, an image of which is captured by the camera 472 and by the camera 472' through a window (not shown) of a carrier insert 515 that is placed on the stored value cards 512 using the second carrier placing station 460, and a sequence number of the carrier insert 515 having the associated carrier bar code 516. Further, the sequence numbers of the stored value cards 512 and/or of the carrier inserts 515 may be stored in the data file by the data capture station 470. That is, the system 400, in one embodiment, is adapted to verify that a sequence of the stored value cards 512 and of the carrier inserts 515 is maintained in-line in the system 400. In another embodiment, the association between the card bar codes 514 and the carrier bar code 516 may be verified by synchronizing the timing of the conveyor 402 and the cameras 472 and 472'.

The data capture station 470, in one embodiment, further includes a computer similar to the computer 176' described above and including a software system adapted to create a data file associating, or linking, each of the card bar codes 514 of the stored value cards 512 with the carrier bar code 516. The software system, in one embodiment, creates the data file using the images created by the cameras 472 and 472'. In one embodiment, the data capture station 470 creates a composite image of the images captured by the cameras 472 and 472'.

Figure 33:
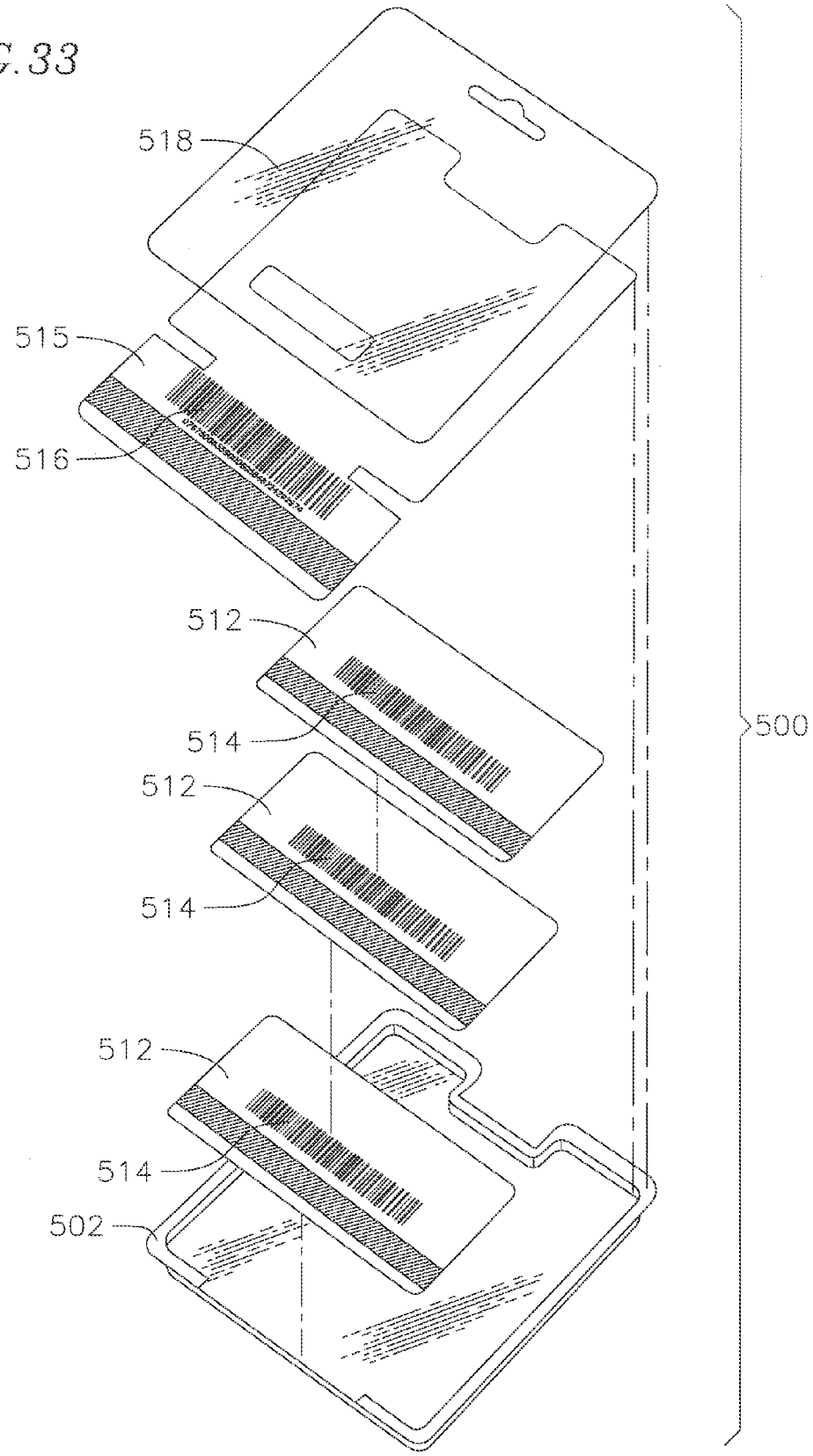
FIG. 33 is an exploded view of a card multipack constructed using the automated system for constructing card multipacks of FIG. 32.

With reference to FIG. 33, the card multipack 500 according to an embodiment of the present invention is shown. The card multipack 500, for example, may be constructed using the automated system 400 described above. The card multipack 500 contains one or more of the stored value cards 512 each having one of the card bar codes 514. In one embodiment, the card multipack 500 includes a first carrier shell 502 on which the stored value cards 512 are placed. The card multipack 500 further includes the carrier insert 515 placed over the stored value cards 512 and having the carrier bar code 516 on a surface which, in one embodiment, faces a same direction as surfaces of the stored value cards 512 having the card bar codes 514 and in which the image of the carrier bar code 516 may be captured by the camera 472'. The carrier bar code 516 is readable, or scannable, and is located on an exterior of the card multipack 500 after the card multipack 500 has been sealed. Further, in one embodiment, the carrier insert 515 may have a window similar to the window 22 of the carrier base 20 described above through which one or more of the stored value card bar codes 514 is readable, such as for sequence checking or verification purposes. In one embodiment, the card multipack 500 further includes a second carrier shell 518 placed over the carrier insert 515 and which may be sealed together with the first carrier shell 502.

Figure 34:
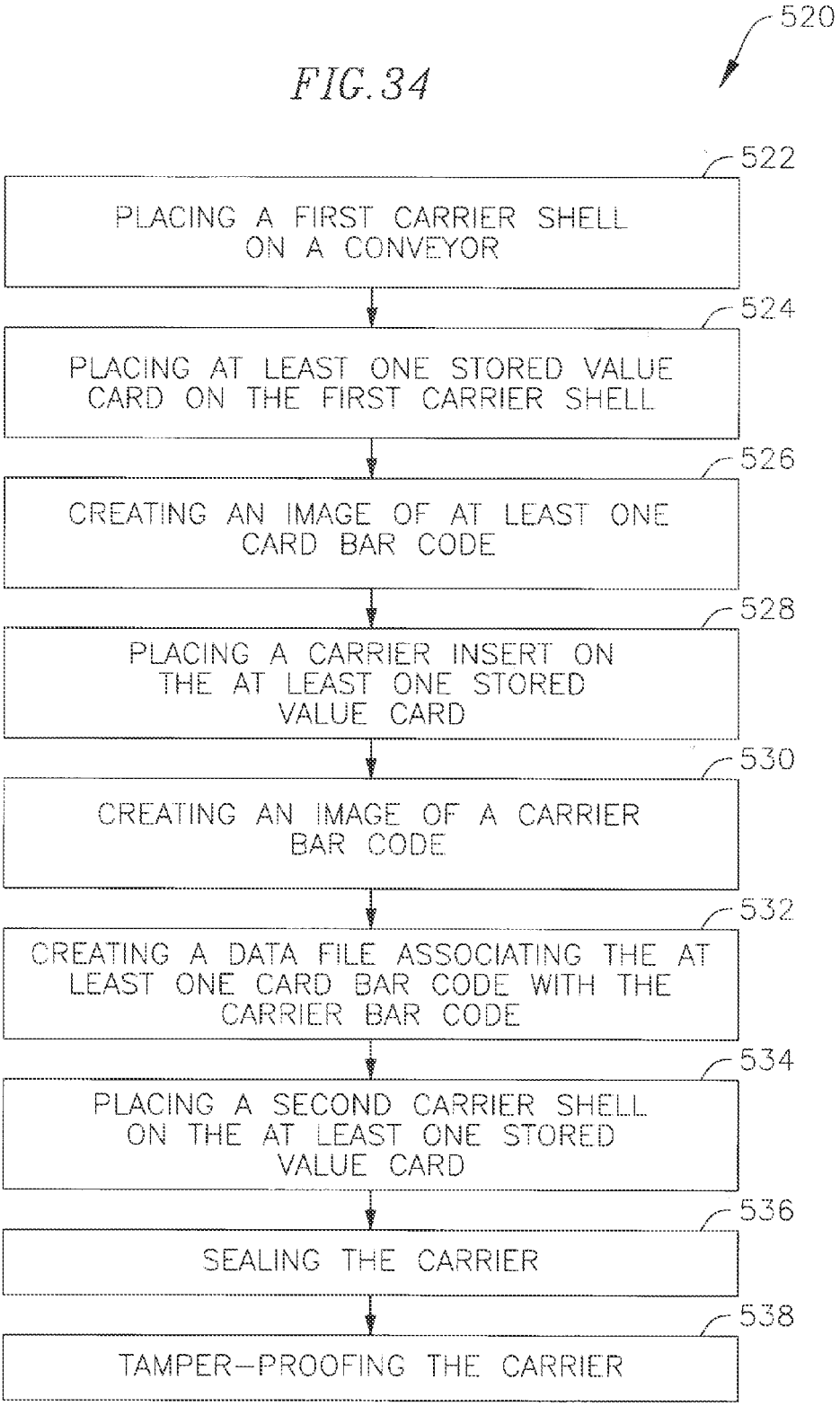
FIG. 34 is a flowchart showing tasks of a method of constructing a card multipack using the automated system for constructing card multipacks of FIG. 32.

With reference to FIG. 34, a method 520 of constructing a card multipack is shown. The method 520, in one embodiment, may be performed in constructing the card multipack 500 using the system 400 for constructing card multipacks described above and shown in FIG. 32. However, in other embodiments, the method 520, or at least some of the tasks thereof, may be performed in constructing card multipacks according to other embodiments of the present invention and/or using an automated system or apparatus for constructing card multipacks according to other embodiments of the present invention.

The method 520 includes a task 522 of placing the first carrier shell 502 of the card multipack 500 on the conveyor 402, such as by using the first carrier placing station 410.

The method 520 further includes a task 524 of placing one or more of the stored value cards 512 on the first carrier shell 502, such as by using one or more of the card placing stations 420, 430, 440, 450. In one embodiment, an adhesive may be dispensed onto at least one of the stored value cards 512, such as by using an adhesive dispensing device.

In the method 520 of constructing a card multipack, a task 526 of creating a first image of the card bar codes 514 of the stored value cards 512 is performed using the camera 472. As described above, in one embodiment, the camera 472 is located in-line in the system 400 such that the image of the card bar codes 514 is taken prior to the second carrier placing station 460 placing the carrier insert 515 over the stored value cards 512.

The method 520 further includes a task 528 of placing the carrier insert 515 of the card multipack 500 on the stored value cards 512, such as by using the second carrier placing station 460. In one embodiment, the carrier bar code 516 may be printed on the carrier insert 515 before the carrier insert 515 is placed on the stored value cards 512. Further, the carrier inserts 515 may be sequentially arranged in a holding rack of the second carrier placing station 460 according to a predetermined order (e.g., according to a desired range of values of the card multipacks 500). However, in another embodiment, the carrier inserts 515 may be placed on the card multipacks 500 in any random order.

The method 520 further includes a task 530 of creating a second image of the carrier bar code 516 using the camera 472'. In one embodiment, the task 530 is performed subsequent to the carrier insert 515 being placed on the stored value cards 512. The method further includes a task 532 of creating a data file associating the card bar codes 514 of the stored value cards 512 with the carrier bar code 516, such as by using the images (e.g., a composite image) taken by the cameras 472 and 472'.

The method 520 of constructing a card multipack, according to one embodiment, further includes a task 534 of placing the second carrier shell 518 over the carrier insert 515, such as by using the third carrier placing station 480, a task 536 of sealing the card multipack 500 using the sealing station 490, and a task 538 of tamper-proofing the card multipack 500 using the tamper-proofing station 498. In another embodiment, the task 536 of sealing the card multipack 500 and the task 538 of tamper-proofing the card multipack 500 may be performed at a single station.

Figure 35:
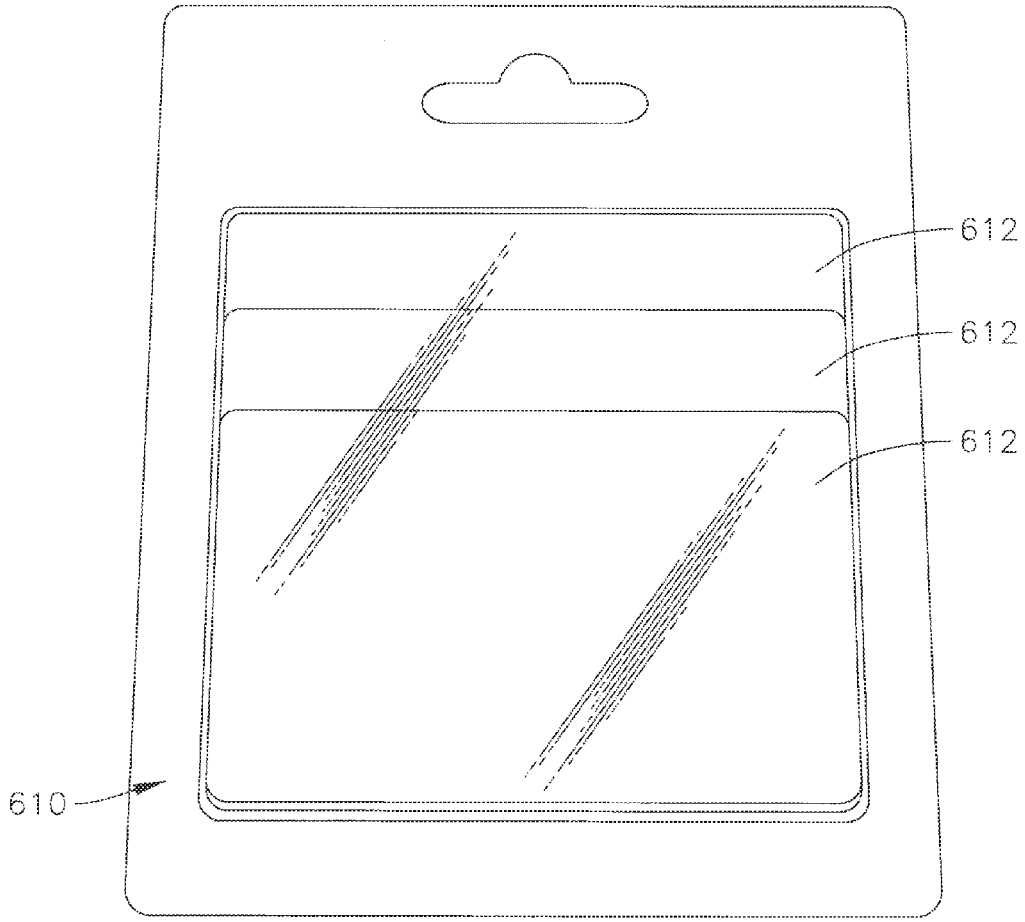
FIG. 35 is a front view of a card multipack constructed using an automated system for constructing card multipacks, according to another embodiment of the present invention.
Figure 36:
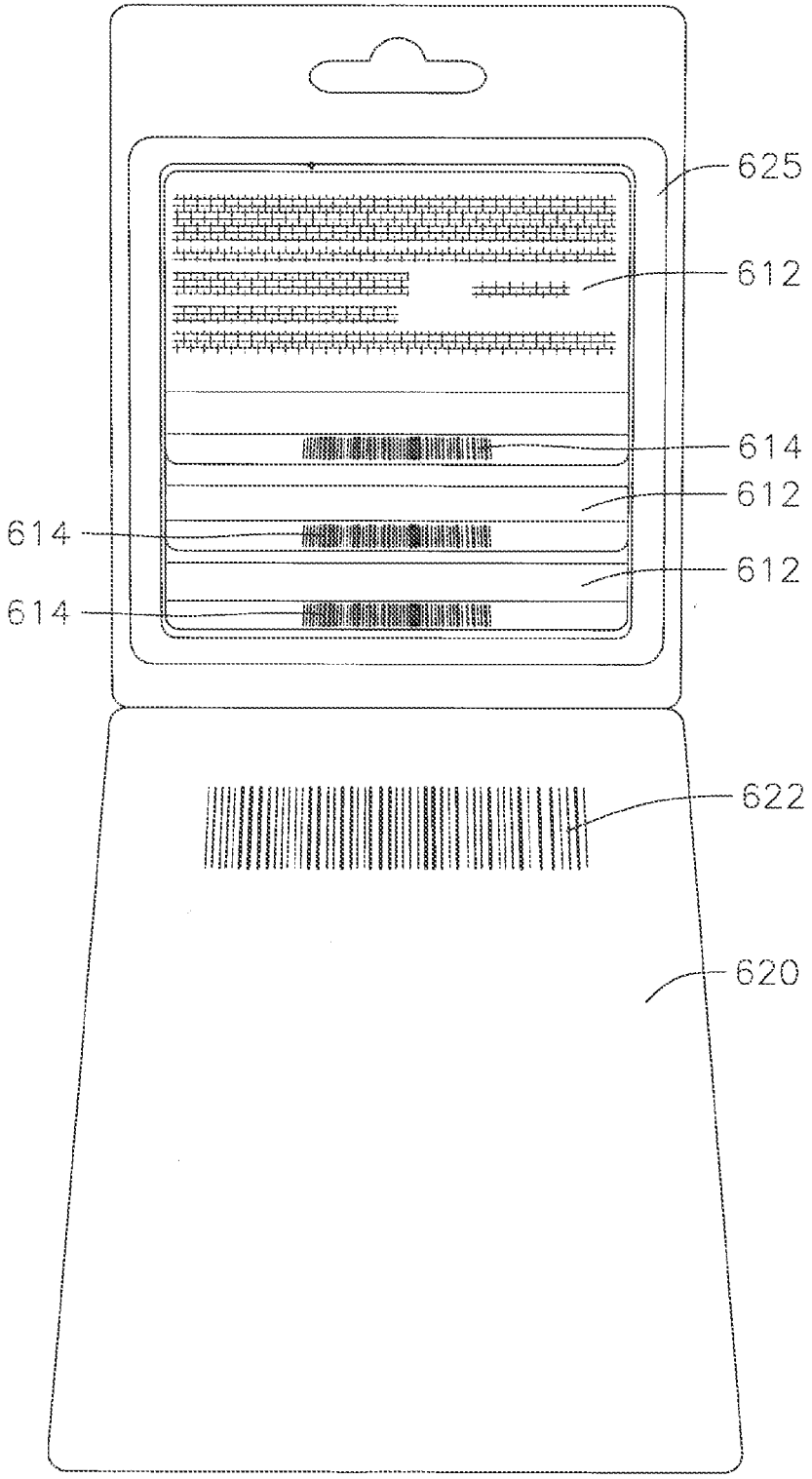
FIG. 36 is a rear view of the card multipack of FIG. 35, shown in an unfolded state.
Figure 37:
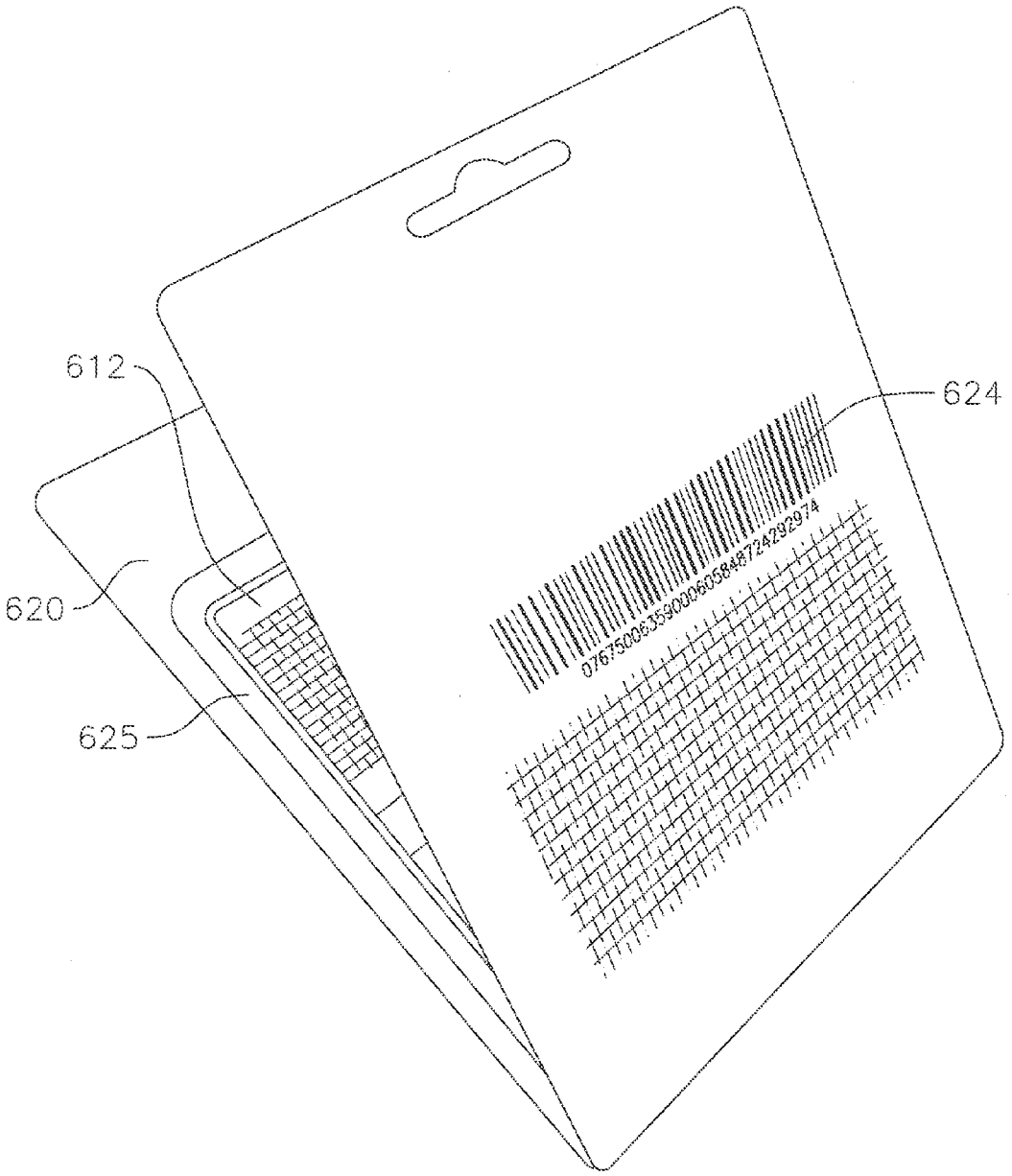
FIG. 37 is a rear view of the card multipack of FIG. 35, shown in an unsealed state.

With reference to FIGS. 35-37, a card multipack 610 according to another embodiment of the present invention is shown. The card multipack 610, for example, may be constructed using the automated system 100 described above. In FIG. 35, the card multipack 610 is shown in a sealed state containing one or more (e.g., three) stored value cards 612. FIG. 36 shows the card multipack 610 in an unfolded state and shows a card bar code 614 on each of the stored value cards 612. In one embodiment, as also shown in FIG. 36, the card multipack 610 includes a carrier base 620 and a first carrier shell 625 holding the stored value cards 612. The carrier base 620 has a first carrier bar code 622 on a first surface which, in one embodiment, faces a same direction as surfaces of the stored value cards 612 having the card bar codes 614. The card multipack 610 is shown in a folded, but unsealed, state in FIG. 37. In one embodiment, as shown in FIG. 37, the carrier base 620 has a second carrier bar code 624 which is readable, or scannable, and is located on an exterior of the card multipack 610 after the card multipack 610 has been sealed. In one embodiment, as illustrated by FIGS. 36 and 37, the carrier base 620 is folded prior to or during sealing of the card multipack 610, and the second carrier bar code 624 is located on a surface of the carrier base 620 opposite the surface on which the first carrier bar code 622 is located. Further, in one embodiment, the second carrier bar code 624 is the same as the first carrier bar code 622.

The card multipack 610 including both the first carrier bar code 622 and the second carrier bar code 624 may be constructed using the automated system 100 described above and shown in FIG. 1 because the second carrier bar code 624 faces the same direction as the card bar codes 14 and, therefore, an image may be captured of both the second carrier bar code 624 and the card bar codes 14 using the camera 172. That is, the camera 17T of the automated system 100 is not needed below the card multipacks 610.

Although the drawings illustrate the invention as applied to an automated system for constructing card multipacks containing stored value cards, it will be apparent that the novel aspects of the automated system and method of the invention may also be applied to other applications. For example, aspects of embodiments of an automated system and method described herein may be applied to an automated system for constructing packages containing other cards or other items. Further, it will be apparent to those skilled in the art that an automated system for constructing card multipacks may incorporate or embody various combinations of the embodiments described above with respect to the shapes, sizes, and components of the systems and apparatuses, as well as alternatives not described herein, without departing from the spirit and scope of the present invention. Also, while the invention has been described and shown herein with respect to several structures of card multipacks and carriers thereof, the present invention is not limited thereto. That is, in other embodiments, the stored value cards may be contained in any other suitable carrier. For example, in another embodiment of an automated system according to the present invention, a large number of stored value cards may be packaged in a carrier that is a box or other suitable container, such as using a shuffle feeder. For example, the box or other container may have a parent bar code that is associated with child bar codes of the stored value cards, or the box may have a window through which a parent bar code of one of the stored value cards may be associated with child bar codes of other ones of the stored value cards using the automated system according to an embodiment of the present invention. Further, the number of stored value cards in the multipack is not limited by the present invention. Further, in other embodiments of the present invention, data acquisition or capturing is not limited to bar codes or cameras, but, rather, may be performed by any other suitable device, such as via magnetic stripes and magnetic stripe readers. Similarly, in other embodiments of the present invention, the bar codes of one or both of the stored value cards or the carriers may be substituted with magnetic stripes or any other suitable readable data device.

The preceding description has been presented with reference to some exemplary embodiments of the invention. Persons skilled in the art and technology to which this invention pertains will appreciate that alterations and changes in the described structures and methods of assembly and operation can be practiced without meaningfully departing from the principles, spirit, and scope of this invention.

What is claimed is:

1. An automated system for constructing card multipacks, the automated system comprising:

a movable conveyor;

a first carrier placing station configured to place a first carrier portion of a carrier on the conveyor;

at least one card placing station configured to place a plurality of stored value cards on the first carrier portion;

a data capture station configured to read a card bar code of each of the plurality of stored value cards and a carrier bar code of the carrier in-line in the automated system;

a software system adapted to create a data file including the card bar codes and to create in the data file an association between the card bar code of each of the plurality of stored value cards and the carrier bar code for subsequent activation of each of the plurality of stored value cards using the carrier bar code; and a sealing station configured to seal the carrier, wherein the automated system is configured to place the stored value cards, read the card bar codes, create the data file, and seal the carrier in an in-line automated manner, and wherein the data capture station is configured to read the plurality of card bar codes and the carrier bar code between the at least one card placing station and the sealing station.

2. The automated system of claim 1, wherein the first carrier portion comprises the carrier bar code.

3. The automated system of claim 1, wherein the software system is further adapted to create in the data file an association between at least two different card bar codes of at least two stored value cards of the plurality of stored value cards and the carrier bar code for subsequent activation of the at least two stored value cards using the carrier bar code, the automated system being configured to package the at least two stored value cards together with the carrier including the carrier bar code.

4. The automated system of claim 1, wherein the software system is further adapted to create in the data file an association between the card bar code of a parent card of the plurality of stored value cards and the card bar code of each of at least one child card of the plurality of stored value cards for subsequent activation of each of the at least one child card using the card bar code of the parent card.

5. The automated system of claim 1, wherein the at least one card placing station comprises a plurality of card placing stations configured to sequentially place the plurality of stored value cards on the carrier.

6. The automated system of claim 1, wherein the data capture station is configured to read the plurality of card bar codes and the software system is configured to create the data file in-line in the automated system without human interaction.

7. The automated system of claim 1, wherein the card multipacks are gift card multipacks.

8. The automated system of claim 1, wherein the data capture station comprises a first camera configured to create a first image of the plurality of card bar codes, and a second camera configured to create a second image of the carrier bar code, and wherein the software system is adapted to create the data file using the first and second images.

9. The automated system of claim 8, wherein the software system is adapted to create the data file using a composite image made up of the first and second images.

10. The automated system of claim 8, further comprising a second carrier placing station between the first camera and the second camera and configured to place a second carrier portion of the carrier on the stored value cards subsequent to the first camera creating the first image, wherein the second carrier portion comprises the carrier bar code.

11. The automated system of claim 8, wherein, at the data capture station, the carrier bar code faces downward toward the movable conveyor, and the second camera is located below the carrier bar code to capture the second image of the carrier bar code.

12. The automated system of claim 11, further comprising a folding station configured to fold the first carrier portion, subsequent to the second camera capturing the second image of the carrier bar code, such that the first carrier portion covers the plurality of stored value cards and the carrier bar code faces away from the movable conveyor.

13. The automated system of claim 8, wherein the first camera is configured to create the first image of the plurality of bar codes substantially simultaneously with the creation of the second image of the carrier bar code by the second camera.

14. The automated system of claim 8, wherein at the data capture station, the card bar code of each of the plurality of stored value cards faces upward away from the movable conveyor, and the carrier bar code faces downward toward the movable conveyor, wherein the first camera is positioned above the movable conveyor; and wherein the second camera is positioned below the movable conveyor.

15. The automated system of claim 14, wherein:

a section of the movable conveyor at the data capture station comprises a plurality of belts spaced apart from each other in a direction perpendicular to a direction of movement of the conveyor by a gap; and the second camera is positioned below the section of the movable conveyor, and wherein the second camera is configured to create the second image of the carrier bar code by imaging the carrier bar code through the gap.

16. An automated system for constructing card multipacks, the automated system comprising:

a movable conveyor;

a carrier placing station configured to place a carrier portion of a carrier on the conveyor, the carrier comprising a carrier bar code;

at least one card placing station configured to place at least one stored value card on the carrier portion;

a data capture station configured to read at least one card bar code of the at least one stored value card and the carrier bar code of the carrier in-line in the automated system; and a software system adapted to create a data file associating the at least one card bar code with the carrier bar code, a folding station configured to fold the carrier portion into a folded configuration, wherein the automated system is configured to place the at least one stored value card, read the at least one card bar code, create the data file, and seal the carrier in an in-line automated manner, wherein the data capture station is configured to read the at least one card bar code and the carrier bar code subsequent to the placing of the at least one stored value card on the carrier portion, wherein the folding station is configured to fold the first carrier portion subsequent to the data capture station reading the at least one card bar code and the carrier bar code, and wherein the first carrier portion in the folded configuration covers the at least one stored value card.

17. The automated system of claim 16, wherein the data capture station comprises a first camera configured to create a first image of the at least one card bar code, and a second camera configured to create a second image of the carrier bar code, wherein the first camera and the second camera are configured to create the first image and the second image, respectively, subsequent to the placing of the at least one stored value card on the carrier portion, wherein the folding station is configured to fold the first carrier portion subsequent to each of the first camera creating the first image and the second camera creating the second image, and wherein the software system is adapted to create the data file using the first and second images.

18. A method of constructing a card multipack using an automated system, the method comprising:

placing a first carrier portion of a carrier on a conveyor of the automated system using a first carrier placing station of the automated system;

placing a plurality of stored value cards on the first carrier portion using at least one card placing station of the automated system;

reading a plurality of card bar codes of the plurality of stored value cards in-line using a data capture station of the automated system subsequent to the placing of the plurality of stored value yards on the first carrier portion;

reading a carrier bar code of the carrier in-line using the data capture station subsequent to the placing of the plurality of stored value cards on the first carrier portion;

creating a data file including the card bar codes using a software system of the automated system, wherein creating the data file comprises creating an association between the card bar code of each of the plurality of stored value cards and the carrier bar code for subsequent activation of each of the plurality of stored value cards using the carrier bar code; and sealing the card multipack subsequent to the reading of the plurality of card bar codes and the reading of the carrier bar code, wherein the placing the stored value cards, reading the card bar codes, creating the data file, and sealing the carrier are performed in an in-line automated manner using the automated system.

19. The method of dais 18, further comprising placing a second carrier portion including the carrier bar code on the stored value cards using a second carrier placing station of the automated system subsequent to reading the card bar codes and prior to reading the carrier bar code.

20. The method of claim 18, wherein creating the data file comprises creating an association between the card bar code of a parent card of the plurality of stored value cards and the card bar code of each of at least one child card of the plurality of stored value cards for subsequent activation of each of the at least one child card using the card bar code of the parent card.

21. The method of claim 18, wherein reading the card bar codes comprises creating a first image of the card bar codes using a first camera, and reading the carrier bar code comprises creating a second image of the carrier bar code using a second camera, and wherein the data file is created using the first and second images.

22. The method of claim 21, wherein, when reading the carrier bar code using the data capture station, the carrier bar code faces downward toward the conveyor, and the second camera is located below the carrier bar code to capture the image of the carrier bar code.

23. The method of claim 22, further comprising folding the first carrier portion, subsequent to reading the carrier bar code, such that the first carrier portion covers the plurality of stored value cards and the carrier bar code faces away from the conveyor.

* * * * *